US006367912B1

(12) United States Patent
Kishimoto et al.

(10) Patent No.: US 6,367,912 B1
(45) **Date of Patent: *Apr. 9, 2002**

(54) INK JET RECORDING APPARATUS

(75) Inventors: Mitsuru Kishimoto; Hideyuki Kobayashi; Noboru Ooishi; Kiyoshi Ikeda; Takeo Fujii; Hiroyuki Ueki; Masahiko Shimosugi; Shigenori Koido, all of Tokyo (JP)

(73) Assignee: Oki Data Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/177,081

(22) Filed: Oct. 23, 1998

Related U.S. Application Data

(63) Continuation-in-part of application No. 09/026,917, filed on Feb. 20, 1998, now abandoned.

(30) Foreign Application Priority Data

Feb. 24, 1997 (JP) ..... 9-039350
Apr. 10, 1997 (JP) ..... 9-092366
Oct. 24, 1997 (JP) ..... 9-292213

(51) Int. Cl.[7] ..... B41J 2/21; B41J 2/145; B41J 2/15

(52) U.S. Cl. ..... 347/43; 347/40

(58) Field of Search ..... 347/19, 43, 40; 358/529, 1.9

(56) References Cited

U.S. PATENT DOCUMENTS 4,953,015 A * 8/1990 Hayasaki et al. ..... 358/529
4,959,790 A * 9/1990 Morgan ..... 358/1.9
4,963,882 A * 10/1990 Hickman ..... 347/43
5,049,898 A * 9/1991 Arthur et al. ..... 347/19
5,057,852 A * 10/1991 Formica et al. ..... 347/43
5,220,342 A * 6/1993 Moriyama ..... 347/43
5,355,159 A * 10/1994 Kaneko ..... 347/19
5,870,117 A * 2/1999 Moore ..... 347/37
5,971,524 A * 10/1999 Nicoloff, Jr. et al. ..... 347/43

* cited by examiner

*Primary Examiner*—Thinh Nguyen
(74) *Attorney, Agent, or Firm*—Rabin & Berdo, P.C.

(57) ABSTRACT

An ink jet recording apparatus is provided with a black head and a plurality of color heads. The black head has a predetermined number of first orifices aligned at predetermined intervals (e.g. 0.0169 mm) in a sub scanning direction (direction in which a print medium travels). The plurality of color heads eject different colored ink drops. Each color head has the predetermined number of second orifices aligned in the sub scanning direction perpendicular to the main scanning direction. The second orifices of adjacent color heads are aligned in a main scanning direction perpendicular to the sub scanning direction.

10 Claims, 29 Drawing Sheets

$d_1 > d_2 = d_3 = d_4$

FIG.18

BLACK IMAGE DATA

| | | | | | |
|---|---|---|---|---|---|
| 0 | 0 | 0 | 0 | 0 | 0 |
| 0 | 1 | 0 | 0 | 1 | 0 |
| 0 | 1 | 0 | 0 | 1 | 0 |
| 0 | 1 | 1 | 1 | 1 | 0 |
| 0 | 1 | 0 | 0 | 1 | 0 |
| 0 | 1 | 0 | 0 | 1 | 0 |
| 0 | 0 | 0 | 0 | 0 | 0 |

∩

MASK DATA

| | | | | | |
|---|---|---|---|---|---|
| 1 | 0 | 1 | 0 | 1 | 0 |
| 0 | 1 | 0 | 1 | 0 | 1 |
| 1 | 0 | 1 | 0 | 1 | 0 |
| 0 | 1 | 0 | 1 | 0 | 1 |
| 1 | 0 | 1 | 0 | 1 | 0 |
| 0 | 1 | 0 | 1 | 0 | 1 |
| 1 | 0 | 1 | 0 | 1 | 0 |

↑

CYAN IMAGE DATA

| | | | | | |
|---|---|---|---|---|---|
| 0 | 0 | 0 | 0 | 0 | 0 |
| 0 | 1 | 0 | 0 | 0 | 0 |
| 0 | 0 | 0 | 0 | 1 | 0 |
| 0 | 1 | 0 | 1 | 0 | 0 |
| 0 | 0 | 0 | 0 | 1 | 0 |
| 0 | 1 | 0 | 0 | 0 | 0 |
| 0 | 0 | 0 | 0 | 0 | 0 |

FIG.19

BLACK IMAGE DATA

| | | | | | | |
|---|---|---|---|---|---|---|
| 0 | 0 | 0 | 0 | 0 | 0 | 0 |
| 0 | 1 | 0 | 0 | 1 | 0 | 0 |
| 0 | 1 | 0 | 0 | 1 | 0 | 0 |
| 0 | 1 | 1 | 1 | 1 | 0 | 0 |
| 0 | 1 | 0 | 0 | 1 | 0 | 0 |
| 0 | 1 | 0 | 0 | 1 | 0 | 0 |
| 0 | 0 | 0 | 0 | 0 | 0 | 0 |

∩

NOT(MASK DATA)

| | | | | | | |
|---|---|---|---|---|---|---|
| 0 | 1 | 0 | 1 | 0 | 1 | 1 |
| 1 | 0 | 1 | 0 | 1 | 0 | 0 |
| 0 | 1 | 0 | 1 | 0 | 1 | 1 |
| 1 | 0 | 1 | 0 | 1 | 0 | 0 |
| 0 | 1 | 0 | 1 | 0 | 1 | 1 |
| 1 | 0 | 1 | 0 | 1 | 0 | 0 |
| 0 | 1 | 0 | 1 | 0 | 1 | 1 |

↑

THINNED BLACK IMAGE DATA

| | | | | | | |
|---|---|---|---|---|---|---|
| 0 | 0 | 0 | 0 | 0 | 0 | 0 |
| 0 | 0 | 0 | 0 | 1 | 0 | 0 |
| 0 | 1 | 0 | 0 | 0 | 0 | 0 |
| 0 | 0 | 1 | 0 | 1 | 0 | 0 |
| 0 | 1 | 0 | 0 | 0 | 0 | 0 |
| 0 | 0 | 0 | 0 | 1 | 0 | 0 |
| 0 | 0 | 0 | 0 | 0 | 0 | 0 |

FIG.23

| KIND OF PAPER | ORDINARY PAPER A | | | ORDINARY PAPER B | | | COATED PAPER | | |
|---|---|---|---|---|---|---|---|---|---|
| | OD VALUE | a* VALUE | b* VALUE | OD VALUE | a* VALUE | b* VALUE | OD VALUE | a* VALUE | b* VALUE |
| COMPOSITE BLACK | 0.94 | 2.04 | −8.58 | 0.85 | 0.63 | −5.94 | 1.21 | −1.42 | −4.92 |
| SINGLE BLACK | 1.22 | 2.00 | −2.37 | 1.19 | 1.97 | −2.80 | 1.47 | 1.67 | −3.16 |

| | SINGLE BLACK | COMPOSITE BLACK |
|---|---|---|
| PRINT DENSITY | 0.8～1.1 | 1.1～1.35 |
| DOT DIAMETER | 60～80 [μ] | 90～110 [μ] |

INK JET RECORDING APPARATUS

This appln is a continuation-in-part of Ser. No. 09/026,917 filed Feb. 20, 1998, abandoned.

BACKGROUND OF THE INVENTION

1. Field of the Invention

The present in invention relates to ink jet recording apparatuses such as an ink jet printer.

2. Description of Related Art

Conventional ink jet printers include a thermal jet type and a piezoelectric material type. With the thermal jet type printer, an ink pressure chamber is provided with a heater which generates bubbles in accordance with print data. The bubbles expel ink drops through orifices, thereby performing a printing operation.

With the piezoelectric material type printer, electrical signals drive the piezoelectric material to deform, thereby creating internal pressures in the ink pressure chambers. The internal pressure expels the ink drops through orifices to perform a printing operation.

Ink jet printers for a color printing mode are provided with a plurality of groups of orifices, each of the groups corresponding to one of the primary color, i.e., yellow ink, magenta ink, cyan ink, and black ink.

Some printers are equipped with a printhead for black, the printhead having a larger number of orifices than printheads for primary colors so that a single scanning of the printhead in the main scanning direction (perpendicular to a direction in which the print medium travels) allows printing of two consecutive lines. This configuration permits high speed black printing.

Since color printing is performed less frequently than the monochrome printing, the printheads for the primary colors have a lesser number of orifices than does the printhead for black, thereby maintaining the cost of the color printer as low as possible.

Referring to FIG. 25, a printhead 11 includes four orifice plates 13–16. The orifice plates 13 and 14 are for a black head 11B. The orifice plates 15 and 16 are for yellow head 11Y, magenta head 11M, and cyan head 11C. The yellow head 11Y is at a leading end of the main scanning direction (illustrated at the upper side of FIG. 25) and the cyan head 11C is at a trailing end (illustrated at the lower side of FIG. 25). The magenta head 11M is between the yellow head 11Y and the cyan head 11C.

Each of the orifice plates 13 and 14 is formed with 54 orifices 12B at intervals of P1=0.169 mm such that orifices in one of the two plates are between those in the other plate. In other words, the orifices in the orifice plates 13 and 14 are staggered by P2=P½ (about 0.085 mm). Thus, the black head 11B has 108 orifices 12B which in effect provide a resolution or density of 300 DPI (Dots Per Inch).

Each of the orifice plates 15 and 16 is formed with 16 orifices 12Y for yellow ink at intervals of P1=0.169 mm such that orifices in one of the two plates are between those in the other plate. Thus, the yellow head 11Y has 32 orifices 12Y which effectively provide a resolution of 300 DPI (Dots Per Inch). Likewise, the orifice plates 15 and 16 are formed with orifices 12M and 12C arranged in the same manner as the orifices 12Y, so that magenta head and cyan head also provide a resolution of 300 DPI, respectively.

A total of 54 orifices 12B arranged at intervals of 0.169 mm covers approximately 9 mm(=0.169 mm×54). Therefore, if one line has a width of ⅙ in., driving the black head 11B to scan one time in the main scanning direction allows printing of two lines. Thus, the black printing can be fast.

The yellow head 11Y, magenta head 11M, and cyan head 11C each have as many orifices as about one-third the black head 11B. Accordingly, the color printing is performed at a speed that is about one-third the speed of the black printing.

SUMMARY OF THE INVENTION

An object of the invention is to provide an ink jet printer which can perform high speed printing without having to increase the manufacturing cost of the printer.

An ink jet recording apparatus comprises a black head and a plurality of color heads.

The black head has a predetermined number of first orifices aligned at predetermined intervals (e.g. 0.169 mm) in a sub-scanning direction (direction in which a print medium travels).

The plurality of color heads eject different colored ink drops. Each color head has the predetermined number of second orifices aligned in a direction parallel to the sub-scanning direction. All of the second orifices are aligned in directions parallel with a main scanning direction. The main scanning direction is perpendicular to the sub-scanning direction.

A black printing may be performed in a composite-black mode where a predetermined number of the color heads eject different colored ink drops to print one color dot one over the other to form a composite-black dot on a print medium. The composite-black mode prevents missing dots from the printer output resulting from ink exhaustion in the middle of the printing operation.

Black printing may be performed in an ink save mode where the black head ejects a black ink drop to form a black dot and at least one of the color heads ejects a corresponding colored ink drop to form a colored dot, so that the black dot and the colored dot are present on the print medium. The ink save mode prevents the missing dots from the printer output data resulting from the fact that ink runs dry in the middle of the printing operation.

A black printing may be performed in the composite-black mode while also using the black head. The black head ejects a black ink drop to form a single-black dot and the color heads eject corresponding colored ink drop to form a composite-black dot, the single-black dot and the composite-black dot being of different sizes.

A black printing may be performed in a high resolution mode using only black ink. The black head is moved in the second direction while ejecting ink drops onto the print medium in accordance with print data. Subsequently, one of the black head and the print medium is moved with respect the other such that the black head is displaced a distance substantially equal to a half the predetermined interval in the first direction. Finally, the black head is moved in a third direction opposite to the second direction while ejecting ink drops onto the print medium in accordance with the print data. The high resolution mode provide high resolution print quality with reduced printing speed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 18 illustrate a method of generating cyan image data;

FIG. 19 illustrates a method of generating black image data;

FIG. 23 shows a table which lists the tones of printer outputs when a printing were performed using composite black and single black;

DETAILED DESCRIPTION OF THE PREFERRED EMBODIMENTS

The present invention will be described in detail with reference to the drawings.

First Embodiment

Figure 1:
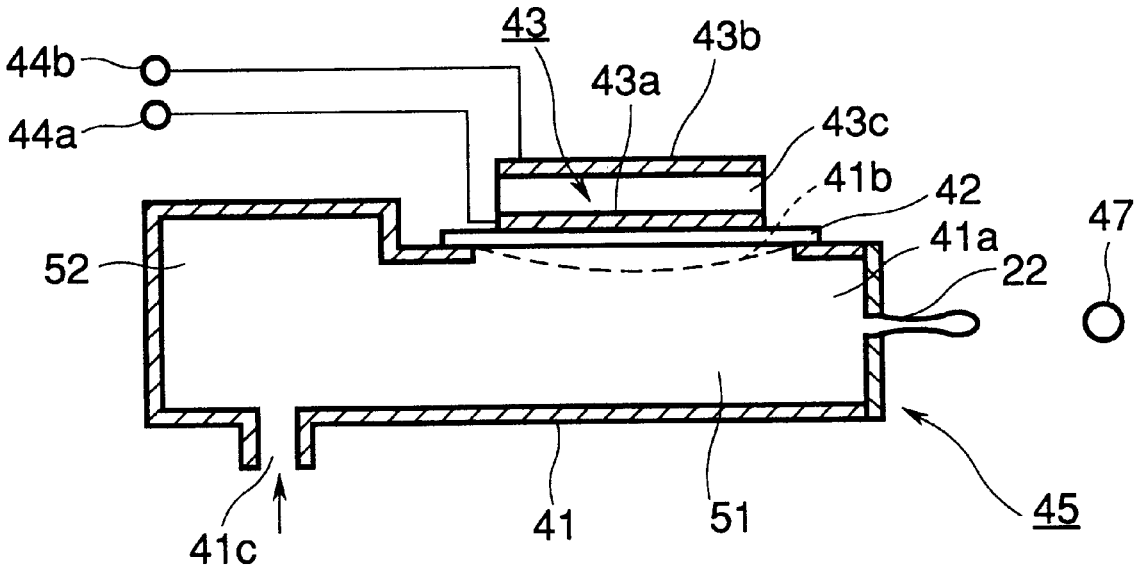
FIG. 1 is a cross-sectional view of one of a plurality of ink pressure chambers of a printhead of a first embodiment.

FIG. 1 is a cross-sectional view of one of a plurality of ink pressure chambers of a printhead of a first embodiment. The ink jet printer includes a plurality of printheads for black ink and different colored inks. Referring to FIG. 1, a body 41 of a printhead 94 is formed with openings 41*a*–41*c*. A diaphragm 42 is mounted to the body 41 to close the opening 41*b* and a pressure generator 43 is mounted on the diaphragm 42. The pressure generator 43 includes a piezoelectric material 43*c* sandwiched between electrodes 43*a* and 43*b*. Electrical signals are supplied via the electrodes 43*a* and 43*b* to the pressure generator 43.

The body 41 is partitioned to define a plurality of ink pressure chambers 51 aligned in a direction normal to the page of FIG. 1. Only one ink pressure is shown in FIG. 1. An orifice plate 45 is assembled to the body 41 to close the opening 41*a*. The orifice plate 45 is formed with a plurality of orifices 22 therein such that each ink pressure chamber 51 has one orifice. The plurality of ink chambers 51 communicate with a common ink reservoir 52 which receives ink through the opening 41*c* from an ink tank, not shown.

When the electrical signals are supplied to the electrodes 43*a* and 43*b* via the terminals 44*a* and 44*b* from a drive source, not shown, the diaphragm 42 is deformed to create a pressure within the ink pressure chamber 51. The ink pressure chamber 51 then ejects ink drops through the orifice 22 to a print medium such as paper to form dots on the print medium.

Figure 2:
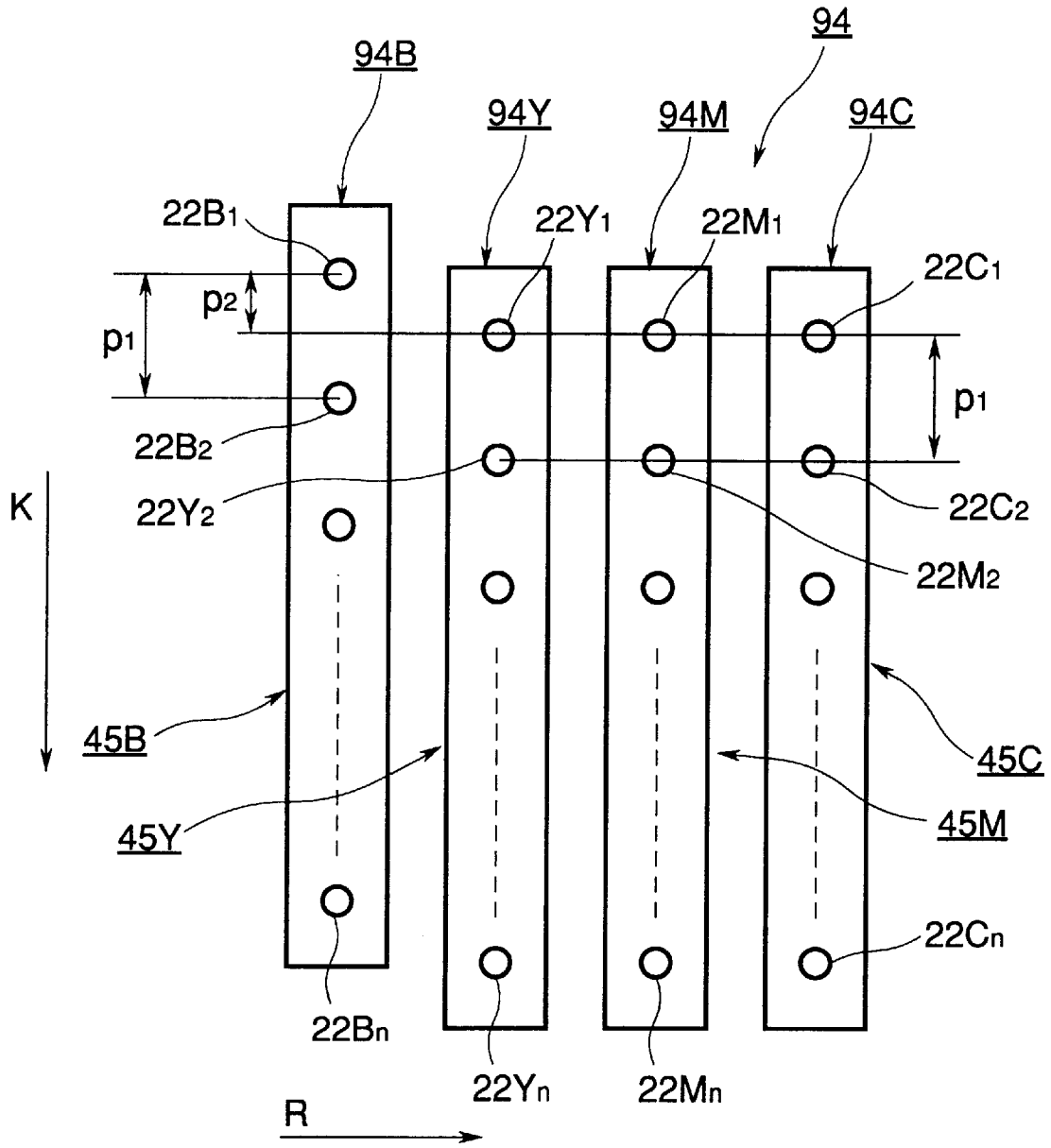
FIG. 2 illustrates the orifices arranged in orifice plates of an ink jet printer.

FIG. 2 illustrates the orifices arranged in orifice plates of an ink jet printer. Referring to FIG. 2, the printhead 94 includes a black head 94B, yellow head 94Y, magenta head 94M, and cyan head 94C to which orifice plates 45B, 45Y, 45M, and 45C are assembled, respectively.

The orifice plates 45B, 45Y, 45M, and 45C are aligned in a direction shown by arrow R and are formed with orifices 22B1–22Bn, 22Y1–22Yn, 22M1–22Mn, and 22C1–22Cn therein, respectively. The Each orifice plate is formed with 54 orifices therein at intervals of P1=0.169 mm, providing a resolution of 150 DPI.

The orifices 22B1–22Bn are aligned in a direction shown by arrow K. The orifices 22Y1–22Yn, 22M1–22Mn, and 22C1–22Cn are arranged so that they are aligned in directions parallel to the direction shown by arrow K and in directions parallel to the direction shown by arrow R. The direction shown by arrow R is perpendicular to the direction shown by arrow K. The orifice plates 45Y, 45M, and 45C are offset by about 0.085 mm in the direction shown by arrow K with respect to the orifice plate 45B so that each orifice of the heads 94Y, 94M, and 94C is between the orifices 22B1–22Bn, except for the last orifices 22Yn, 22Mn, and 22Cn.

The operation of the printhead 94 will now be described.

Figure 3:
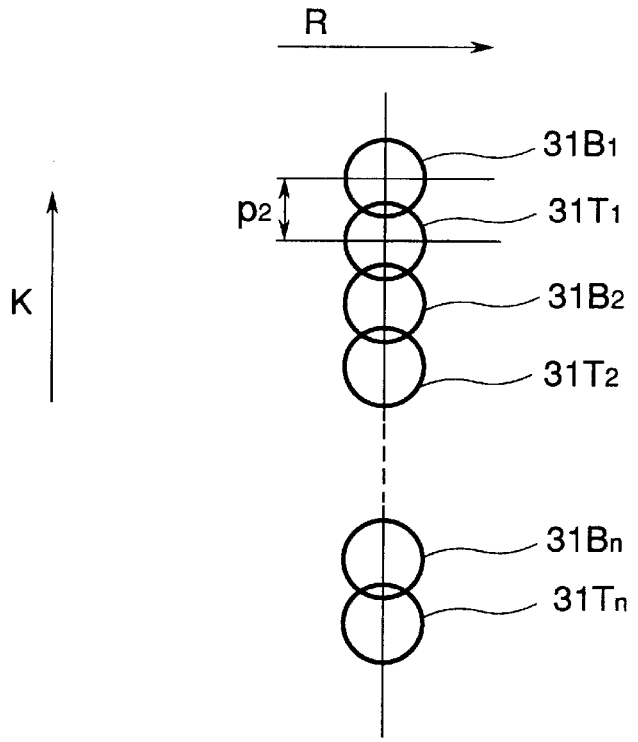
FIG. 3 illustrates the operation of black printing in the first embodiment.

FIG. 3 illustrates the operation of black printing in the first embodiment.

In this specification, the term "black printing" is used to cover a printing operation using black ink and/or colored inks during a monochrome printing.

Figure 6:
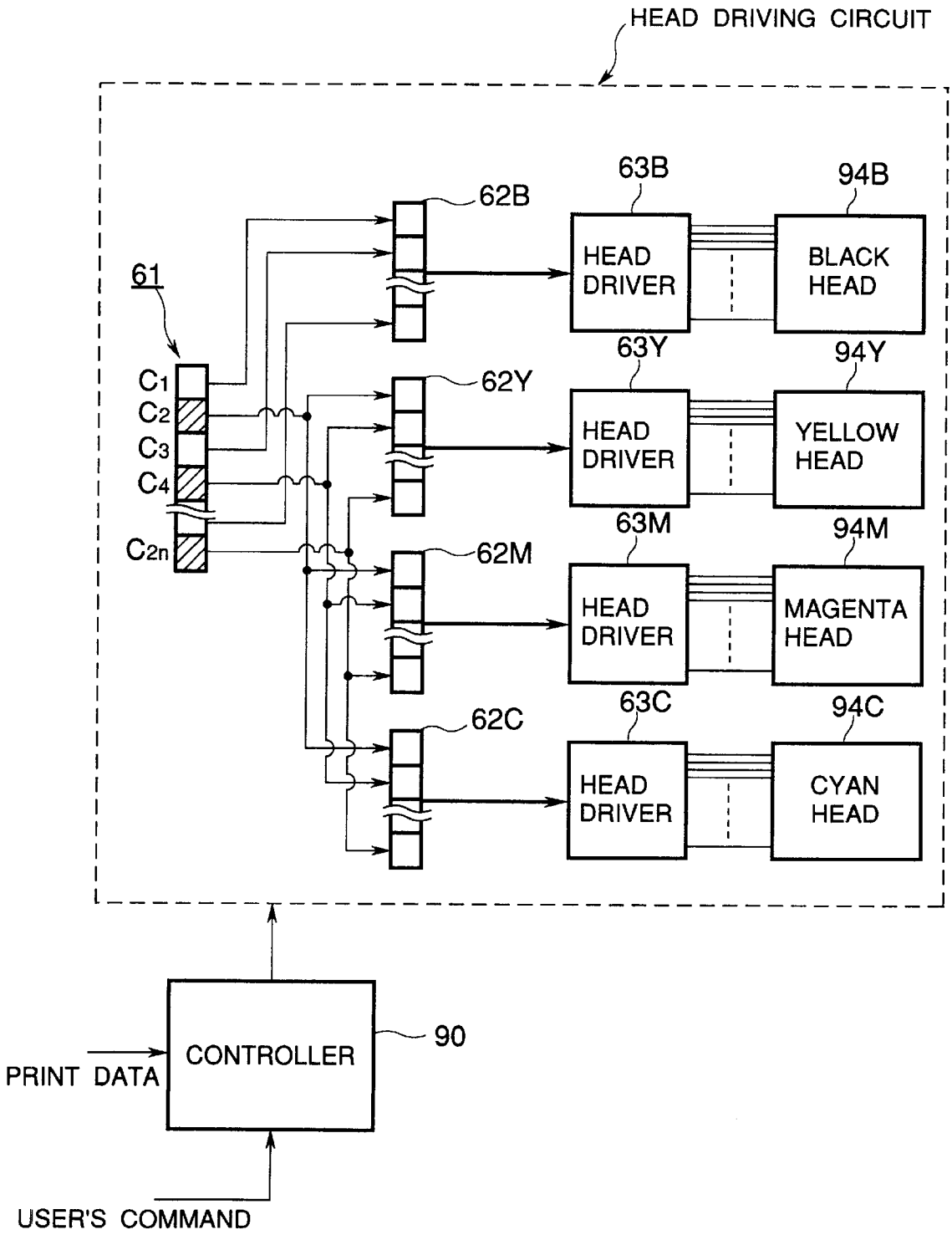
FIG. 6 is a block diagram showing the head-driving circuit according to the second embodiment and a seventh embodiment.

As shown in FIG. 3, the printhead 94 is driven to scan rightward (shown by arrow R) in the main scanning direction while at the same time a head driver, similar to those in FIG. 6, causes the black head 94B to eject black ink drops through the orifices 22B1–22Bn to form dots 31B1–31Bn on the print medium.

The other head drivers cause the yellow head 94Y, magenta head 94M, and cyan head 94C, respectively, to eject yellow ink drops, magenta ink drops, and cyan ink drops through the orifices 22Y1–22n, 22M1–22Mn, and 22C1–22Cn, respectively, thereby forming dots 31T1–31Tn. In this case, the dots 31T1-31Tn are black since the yellow ink, magenta ink, and cyan ink are printed one over the other.

In this specification, the term "composite-black dot" is used to cover "black dot" formed by printing at least two of yellow ink, magenta ink, and cyan ink, and the term "single-black dot" is used to cover "black dot" formed by black ink only.

In this manner, the composite-black dots 31T1–31Tn are formed at locations between the single-black dots 31B1–31Bn, achieving a black printing with a resolution of 300 DPI.

Figure 25:
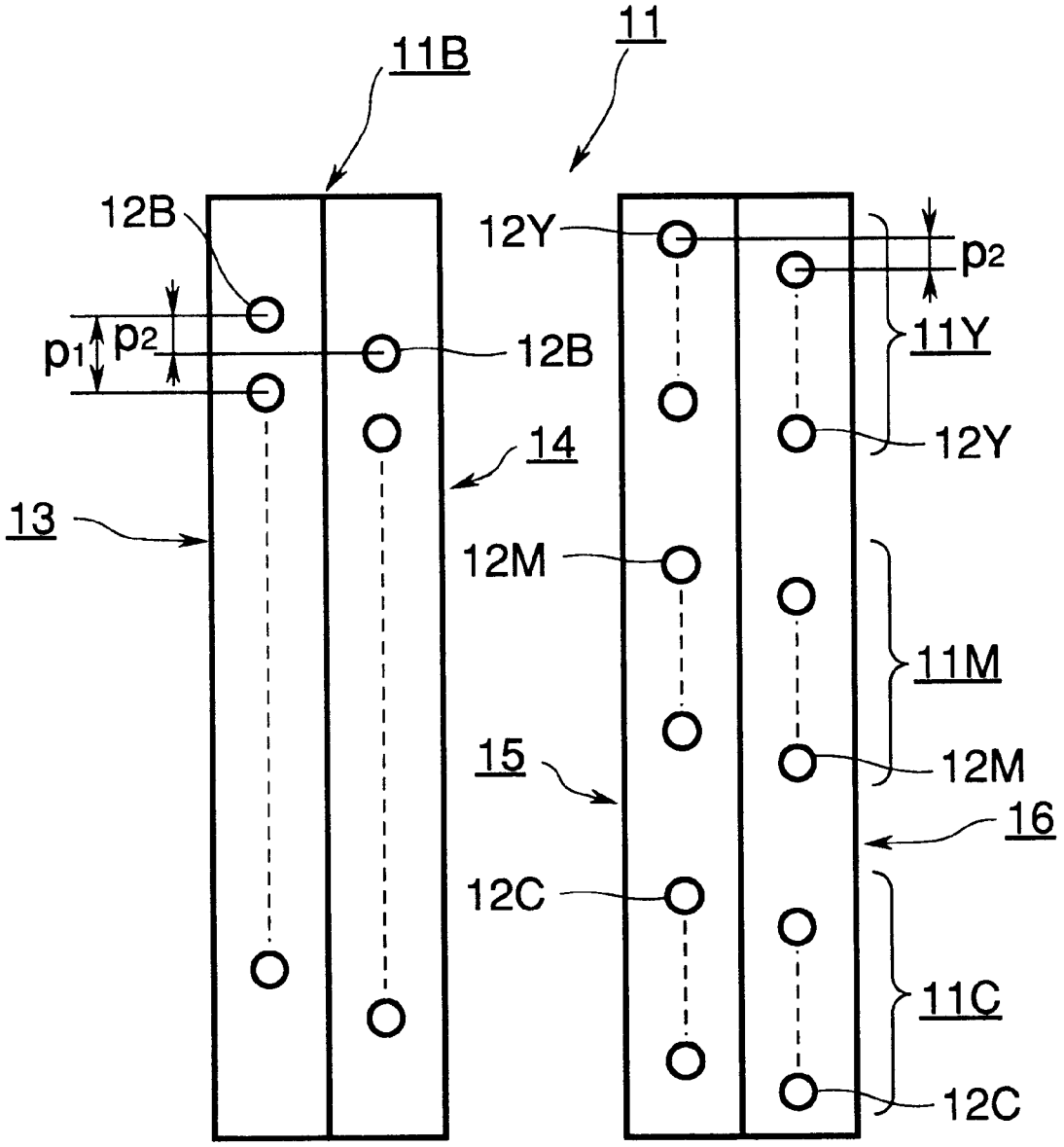
FIG.25 CONVENTIONAL ART
FIG. 25 illustrates an arrangement of orifices in orifice plates of a conventional ink jet printer.

It is to be noted that scanning the printhead 94 only one time in the main scanning direction provides a resolution of 300 DPI in the black printing. This indicates that the present invention provides the same printing speed in the black printing as the conventional ink jet printer shown in FIG. 25.

The operation of the printhead 94 in a color printing will now be described taking the yellow printhead 94Y as an example.

Figure 4:
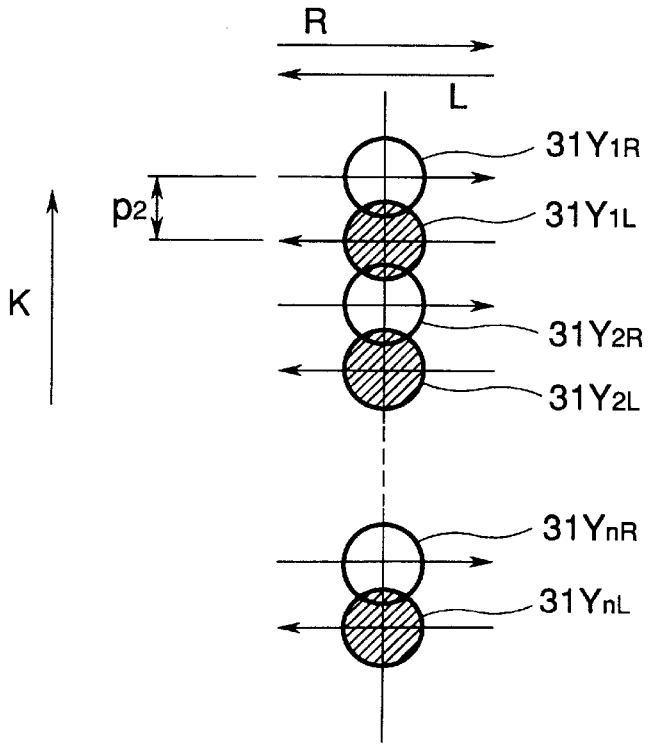
FIG. 4 illustrates the operation of a printhead during the color printing.

FIG. 4 illustrates the operation of the printhead 94 during the color printing.

The head-driver drives the printhead 94 to scan in a direction shown by arrow R (rightward in the main scanning direction) while also causing the yellow head 94Y to eject yellow ink drops through the orifices 22Y1–22Yn to form non-hatched dots $\mathbf{31}y_{1R}$–$\mathbf{31}Y_{nR}$ as shown in FIG. 4. Then, print medium is advanced a distance P2=P½ in the sub scanning direction such that the printhead is closer to the trailing end of the print medium. Alternatively, the printhead 94 may be displaced a distance P2=P½ with respect to the print medium in a direction opposite to the sub scanning direction K with the print medium remaining at the same position. In other words, the printhead 94 may be displaced toward the trailing end of the print medium with the print medium stationary. Subsequently, the head driver causes the printhead 94 to scan in a direction shown by arrow L (leftward in the main scanning direction) to form hatched dots $\mathbf{31}Y_{1L}$–$\mathbf{31}Y_{nL}$ as shown in FIG. 4.

In this manner, yellow printing is performed with a resolution of 300 DPI.

When performing the color printing, the printhead 94 needs to be moved only twice to form 108 dots in the sub scanning direction in order to provide a resolution of 300 DPI. Scanning the printhead in this manner, the present invention provides a printing speed in the color printing about 40% higher than the conventional printer shown in FIG. 25.

In other words, the first embodiment improves the printing speed in the color printing while still maintaining the printing speed in the black printing of the conventional ink jet printer. The complexity of the printhead and driving circuits for driving the printhead, not shown, are substantially the same as that of the conventional printer shown in FIG. 25 since the printhead 94 of the invention has substantially the same number of orifices 22B1–22Bn, 22Y1–22Yn, 22M1–22Mn, and 22C1–22Cn as the conventional printhead 11. The construction of the first embodiment provides a higher printing speed without additional manufacturing costs.

During the black printing, not only the orifices 22B1–22Bn eject black ink but also the orifices 22Y1–22Yn, 22M1–22Mn, and 22C1–22Cn eject yellow ink, magenta ink, and cyan ink. Such frequent ejection of the respective inks prevents all of the inks from denaturing and therefore prevents clogging of the orifices due to denatured ink.

Second Embodiment

Figure 5:
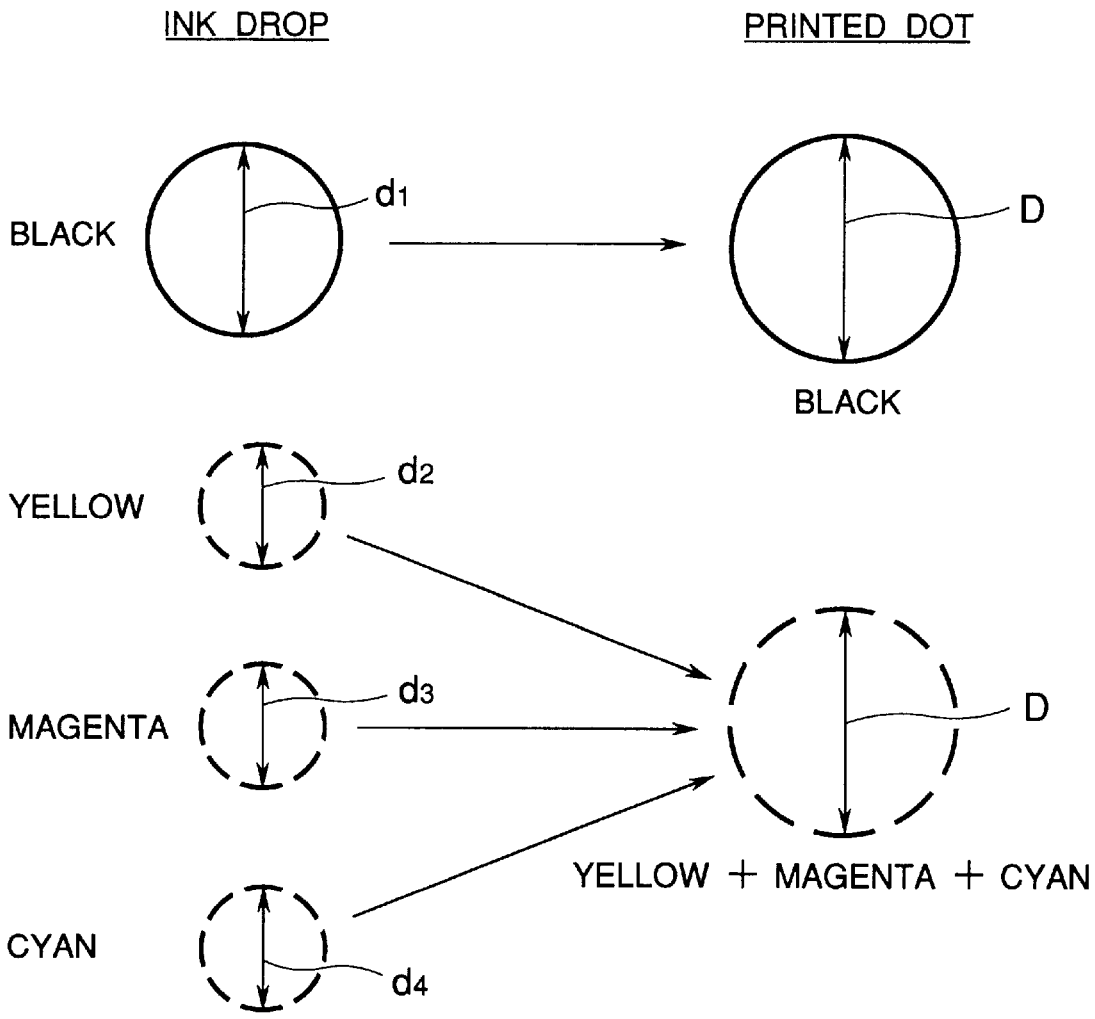
FIG. 5 illustrates dots in the second embodiment.

FIG. 5 illustrates dots in the second embodiment and dots in the first embodiment.

Referring to FIG. 5, the black head ejects a black ink drop having a diameter of d1 to form a black dot having a diameter D on the print medium. If the yellow head, magenta head, and cyan head eject yellow ink drop, magenta ink drop and cyan ink drop of the same size as the black ink drop, the wet colored ink drops printed one over the other tend to spread on the print medium and therefore the three colored-ink drops makes a composite-black dot as shown in dotted line, the composite-black dot being larger than the solid line circle. As a result, the printed composite-black dots 31T1–31Tn may be larger in diameter than the single-black dots 31B1–31Bn printed by black ink.

A second embodiment is to solve this drawback.

According to the second embodiment, the diameter d2 of ink drops of the respective colors are made smaller than that d1 of black ink drop such that the resultant composite-black dot has the same diameter D as the black dot printed in black ink.

For this purpose, the electrical signals applied to the electrodes 43*a* and 43*b* are decreased in voltage or duration during the black printing so that the orifices 22Y1–22Yn, 22M1–22Mn, and 22C1–22Cn eject smaller ink drops.

Thus, composite-black dots 31T1–31Tn formed by printing yellow, magenta, and cyan inks one over the other are of the same size as the single-black dots 31B1, 31B2, . . . , 31Bn formed by black ink, improving print quality.

FIG. 6 is a block diagram showing the head-driving circuit according to the second embodiment.

The operation of a head-driving circuit used in the second embodiment will be described with reference to FIG. 6.

Referring to FIG. 6, a storage block 61 includes 2n cells C1 to C2n which stores print data received from a host apparatus, not shown.

Odd numbered cells C1, C3, C5, . . . , C2n−1 store gradation data dB1, dB2, . . . , dBn used when forming single-black dots 31B1, 31B2, . . . , 31Bn.

Even numbered cells C2, C4, . . . , C2n store gradation data dT1, dT2, . . . , dTn used when forming composite-black dots 31T1, 31T2, . . . , 31Tn.

The duration or voltage of the electrical signal applied across the electrodes 43*a* and 43*b* are changed in accordance with the gradation data. In the present invention, the duration of the electrical signal is changed. The values of duration for the respective levels of gradation are previously determined and stored in storage means, not shown. The gradation can be selected by the user by inputting a command for a specific gradation level from outside.

A storage block 62B stores the gradation data dB1, dB2, dB3, . . . , dBn and storage blocks 62Y, 62M, and 62C store gradation dT1, dT2, dT3, . . . , dTn, respectively.

The head driver 63B drives the black head 94B to form single-black dots 31B, 31B2, . . . , 31Bn in accordance with the gradation data dB1, dB2, . . . , dBn. The head drivers 63Y, 63M, and 63C drive the yellow head 94Y, magenta head 94M and cyan head 94C to form yellow dots 32Y, magenta dots 32M, and cyan dots 32C, respectively, in accordance with the gradation data dT1, dT2, . . . , dTn.

During the black printing, the ratio of the values of gradation data dB1, dB2, dB3, . . . , dBn to the values of gradation data dT1, dT2, . . . , dTn is selected to be 1:0.7. This ratio allows the single-black dots 31B1–31Bn printed by the black head 94B to be of the same size as the composite-black dots 31T1–31Tn printed by the yellow, magenta, and cyan heads.

Third Embodiment

In the first and second embodiments, the composite-black dots 31T1, 31T2, . . . , 31Tn are formed by printing yellow ink, magenta ink, and cyan ink one over the other. The dots printed in this manner may look unusual compared to the dots printed in black ink only. A third embodiment solves such an unusual appearance of the printer output. A general construction of the third embodiment is the same as that shown in FIG. 10, A print medium is advanced by a line feed motor (LFM). The printhead 94 is driven by a spacing motor (SPM) to scan the print medium in the main scanning direction while at the same time a head driver causes the black head 94B to eject black ink drops through the orifices 22B1–22Bn to form dots $\mathbf{35}B_{1R}$–$\mathbf{35}B_{nR}$ and $\mathbf{35}B_{1L}$–$\mathbf{35}B_{nL}$n on the print medium.

Figure 7:
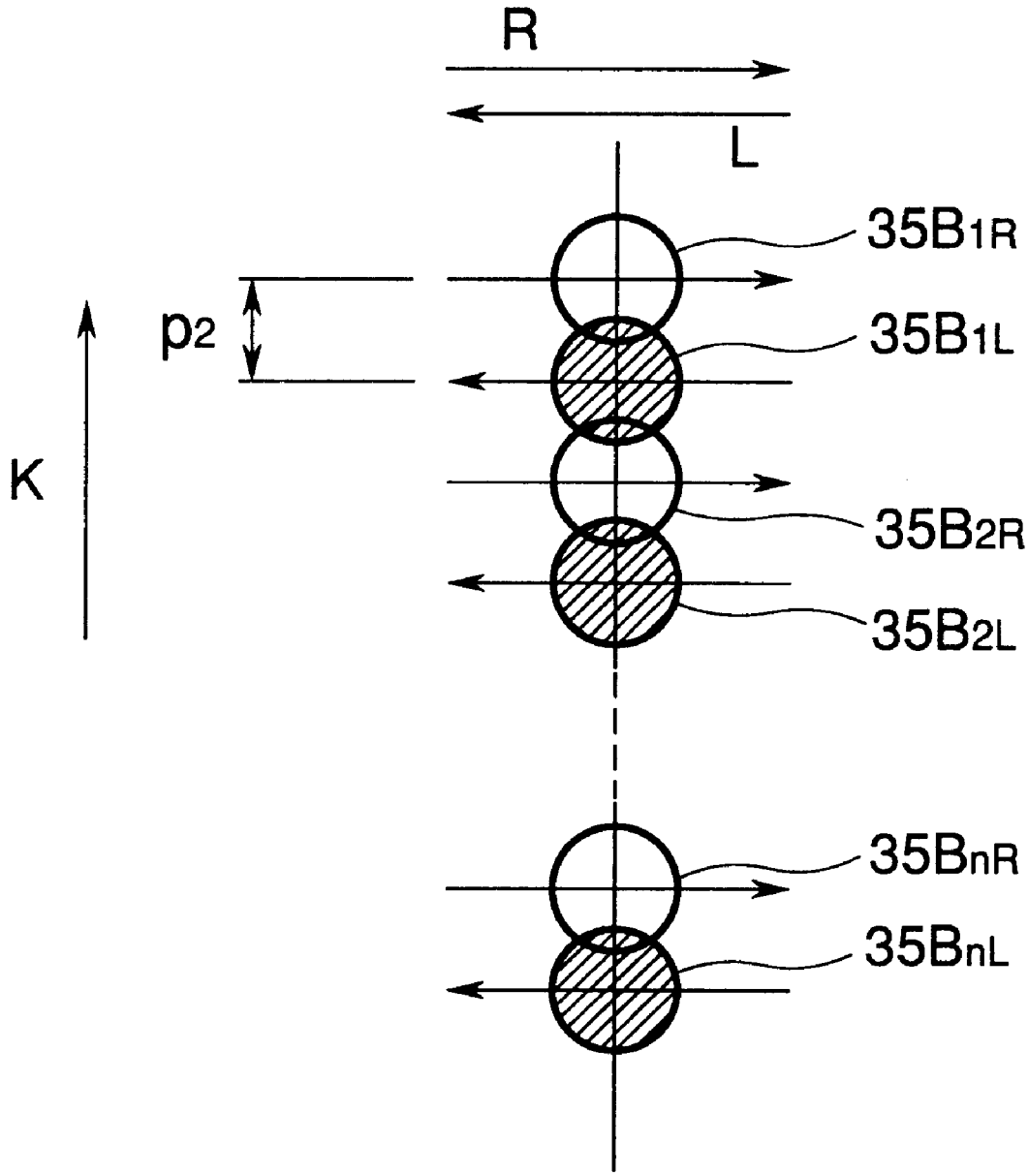
FIG. 7 illustrates the operation of a printhead when performing black printing according to a third embodiment.

FIG. 7 illustrates the operation of a printhead when performing black printing according to the third embodiment. In the third embodiment, the black printing is performed in a high resolution mode.

When a host apparatus, not shown, instructs the printer to perform a printing operation in the high resolution mode, head driving means, not shown, causes a printhead 94 to move in a direction shown by arrow R (rightward in the main scanning direction in FIG. 7) while firing black ink drops from the orifices 22B1, 22B2, . . . , 22Bn of the black head 94B to form non-hatched single-black dots $\mathbf{35}B_{1R}$, $\mathbf{35}B_{2R}$, . . . , $\mathbf{35}B_{n}$R.

Then, the print medium is advanced by a half pitch P2 with respect to the printhead 94 in the sub scanning direction K, and subsequently the head driving means causes the printhead 94 to move in a direction shown by arrow L (leftward in the main direction in FIG. 7) while at the same time the black head 94B ejects black ink drops through the orifices 22B1, 22B2, . . . , 22Bn to form hatched single-black dots $\mathbf{35}B_{1L}$, $\mathbf{35}B_{2L}$, . . . , $\mathbf{35}B_{nL}$. The aforementioned operation provides black printing of a resolution of 300 DPI. Instead of advancing the print medium with respect to the printhead, the printhead may be displaced by a distance equal to a half pitch P2 with respect to the print medium in a direction opposite to the sub scanning direction K.

As mentioned above, in the black printing, the printhead 94 is required to travel rightward (R) and leftward (shown by arrow L) in the main scanning direction as shown in FIG. 7 in order to print one line of 300 DPI. Thus, the printing speed is a half that of the conventional ink jet printer shown in FIG. 25 but black printing can be performed using only black ink, preventing unusual appearance of the printer output.

With the ink jet printers according to the first and second embodiments, the yellow head 94Y, magenta head 94M, cyan head 94C, and black head 94B are connected to ink tanks such that each head receives colored ink from a corresponding ink tank. An ink sensor, not shown, similar to that shown in FIG. 11A, detects the ink level in each tank, and a controller 90 displays characters such as "LOW INK" on a display device, not shown, of a host apparatus when the ink sensor has detected that the ink level of a monitored ink tank is below a predetermined value. If the ink jet recording apparatus has a display device, the indication "LOW INK" may also be displayed on the display device of the ink jet recording apparatus.

Figure 8:
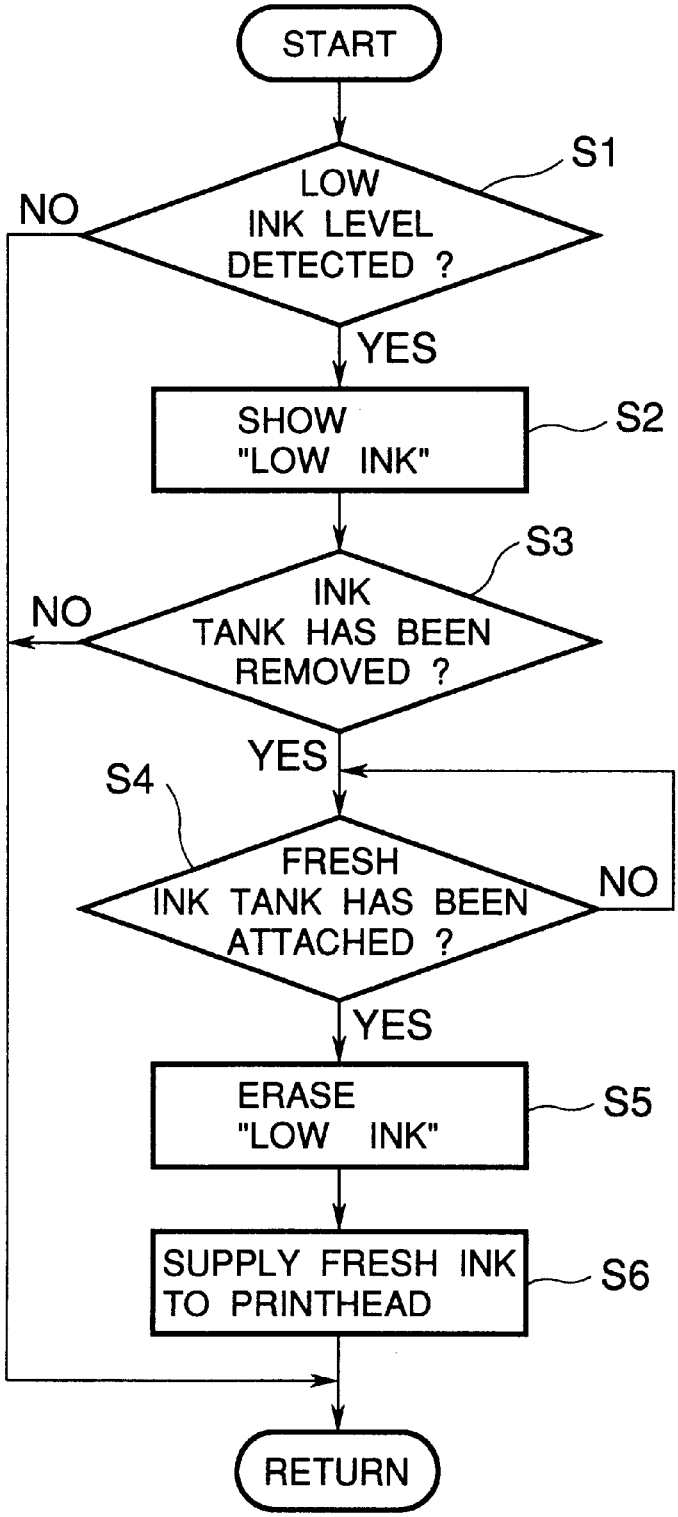
FIG. 8 is a flowchart illustrating the operation of indicating a low-ink condition of an ink tank.

FIG. 8 is a flowchart illustrating the operation of indicating a low-ink condition of an ink tank.

Step 1: The controller 90 check checks the output of the ink sensor to determine whether the ink sensor has detected a low-ink condition of an ink tank. If a low-ink condition has been detected, the ink sensor sends the information on the detected low-ink condition to the host apparatus via an interface, not shown, and the flowchart proceeds to step 2. If the ink sensor has not detected a low-ink condition yet, the flowchart returns.

Step 2: The host apparatus displays, for example, characters such as "LOW INK" on the display device.

Step 3: The controller 90 checks the output of the ink sensor to determine whether the ink tank of a low-ink condition has been removed from the printer. If the ink tank has been removed, the flowchart proceeds to step 4. If not, the flowchart returns.

Step 4: The controller 90 waits till a fresh ink tank has been attached to the printer.

Step 5: If a fresh ink tank has been attached to the printer, the controller erases the message "LOW INK" from the display device.

Step 6: The controller then performs a vacuum operation to supply fresh ink from the ink tank to the printhead 94 (FIG. 2).

In the first to third embodiments, the printhead 94 includes the black head 94B, yellow head 94Y, magenta head 94M, and cyan head 94C. The whole printhead 94 may be made in a one piece construction as shown in FIG. 1. Alternatively, the printhead 94 may have the yellow head 94Y, magenta head 94M, and cyan head 94C formed in a one piece construction and the the black head 94B formed separately. Still alternatively, the black head 94B, yellow head 94Y, magenta head 94M, and cyan head 94C may be made separately and assembled all together.

Fourth Embodiment

It is actually quite rare that the ink tank of a low-ink condition is replaced immediately after the message "LOW INK" appears on a display. In most cases, the ink tank is left attached to the printer till some dots are found absent in the printed image in the middle of the printing operation. Accordingly, ink may be completely exhausted before the printing operation is over, especially during the black printing.

A fourth embodiment is directed to an ink jet printer which prevents missing dots from the printer output resulting from ink exhaustion in the middle of the printing operation.

Figure 9:
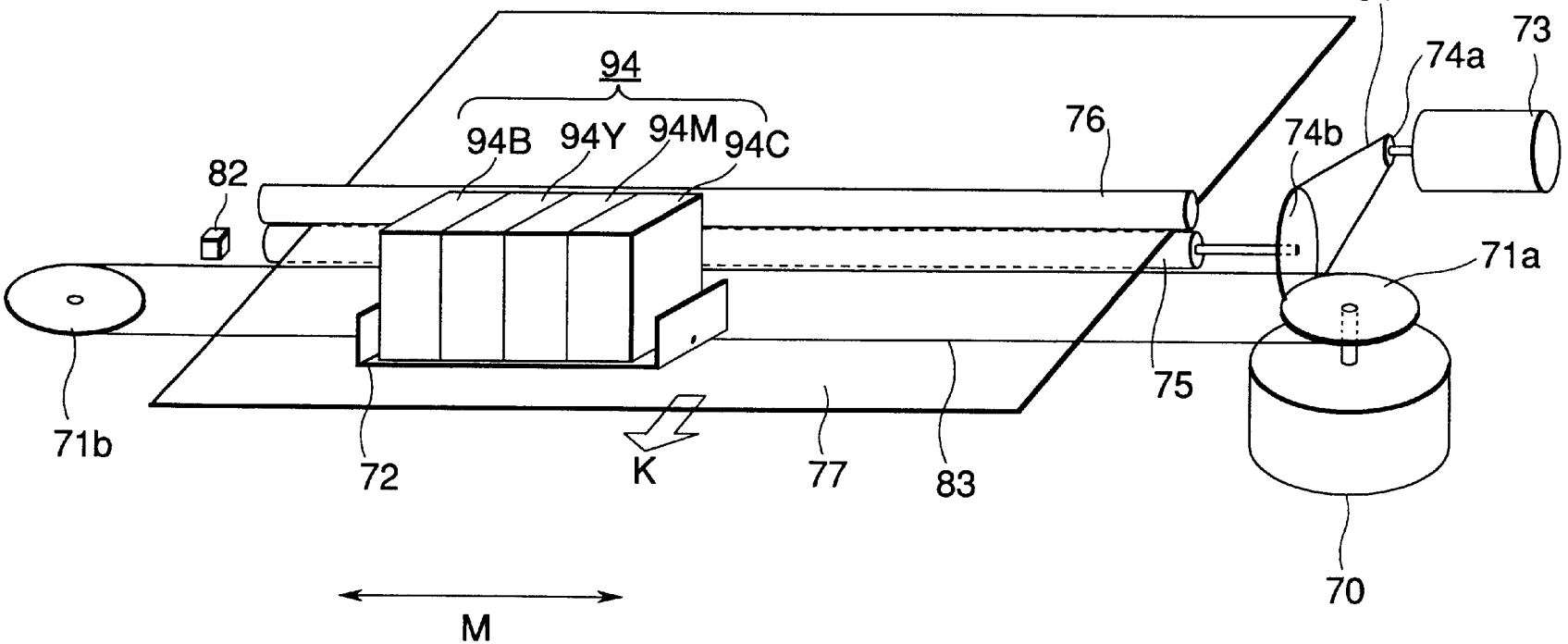
FIG. 9 shows a general construction of an ink jet printer.

FIG. 9 shows a general construction of an ink jet printer. Pulleys 71*a* and 71*b* are spaced a predetermined distance apart. The pulley 71*a* is fixed to the output shaft of a spacing motor 70. The belt 83 is mounted on the pulleys 71*a* and 71*b*. A part of the belt 83 is fixedly connected to a carriage 72.

The carriage 72 carries a printhead 94 thereon which includes a black head 94B, yellow head 94Y, magenta head 94M, and cyan head 94C. Each head communicates with a corresponding ink tank, not shown. When the spacing motor 70 rotates in the forward and reverse directions, the carriage 72 travels back and forth in the main scanning direction shown by arrow M.

Pulleys 74*a* and 74*b* are spaced a predetermined distance apart. The pulley 74*a* is fixedly connected to the output shaft of the line feed motor 73. The pulley 74*b* is fixed to a roller 75 which rotates in contact with a roller 76. Mounted between the pulleys 74*a* and 74*b* is a belt 84. Thus, the line feed motor 73 drives the rollers 75 and 76 in rotation via the belt 84 to transport the print medium 77 therebetween in the sub scanning direction shown by arrow K.

Figure 10:
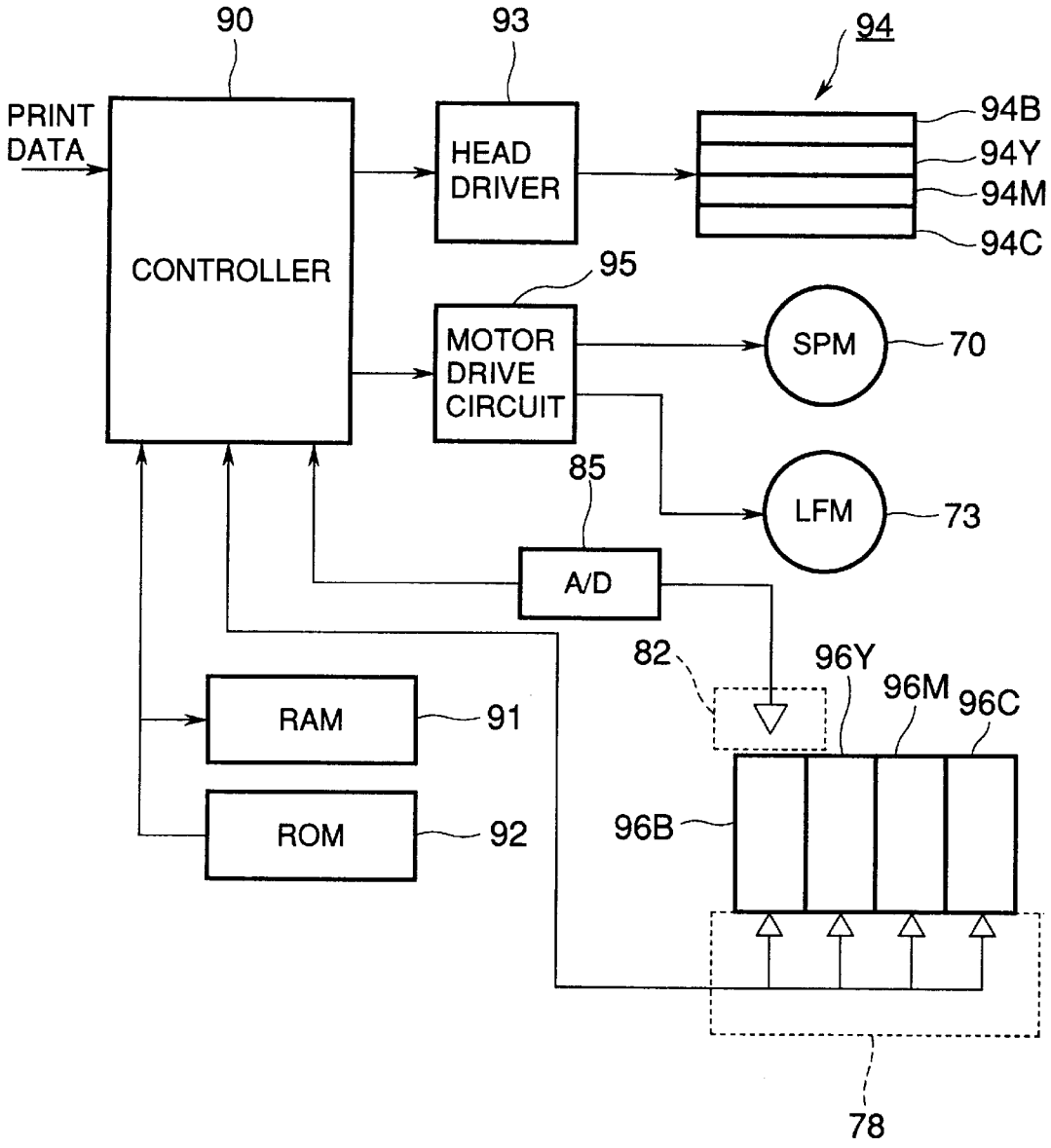
FIG. 10 is a block diagram of a controller of an ink jet printer according to the third and fourth embodiments.

FIG. 10 is a block diagram of a controller of an ink jet printer according to the fourth embodiment. A controller 90 is in the form of a one-chip IC which includes a microprocessor ($\mu$PC), logic circuits (LSI), timer, counter, and so on. The controller 90 controls the entire operation of the ink jet printer under the programs stored in a ROM 92. Data such as control data and print data is stored into and read from a RAM 91.

The controller 90 sends the print data via a head driver 93 to the print head 94, so that the black head 94B, yellow head 94, magenta head 94M, and cyan head 94C each perform printing operations of the corresponding colors.

The controller 90 also controls the spacing motor (SPM) and line feed motor (LFM) via a motor drive circuit 95.

The black head 94B, yellow head 94Y, magenta head 94M, and cyan head 94C are provided with ink tanks 96B, 96Y, 96M, and 96C, respectively. A sensor unit 78 monitors the ink tanks to detect when the ink tanks have been removed from the corresponding heads. A common ink sensor 82 is provided on a chassis of the printer to detect ink levels of the ink tanks. The carriage 72 (FIG. 9) is moved such that the ink sensor 82 opposes an ink tank to be monitored, thereby detecting an ink level of the ink tank.

Figure 11B:
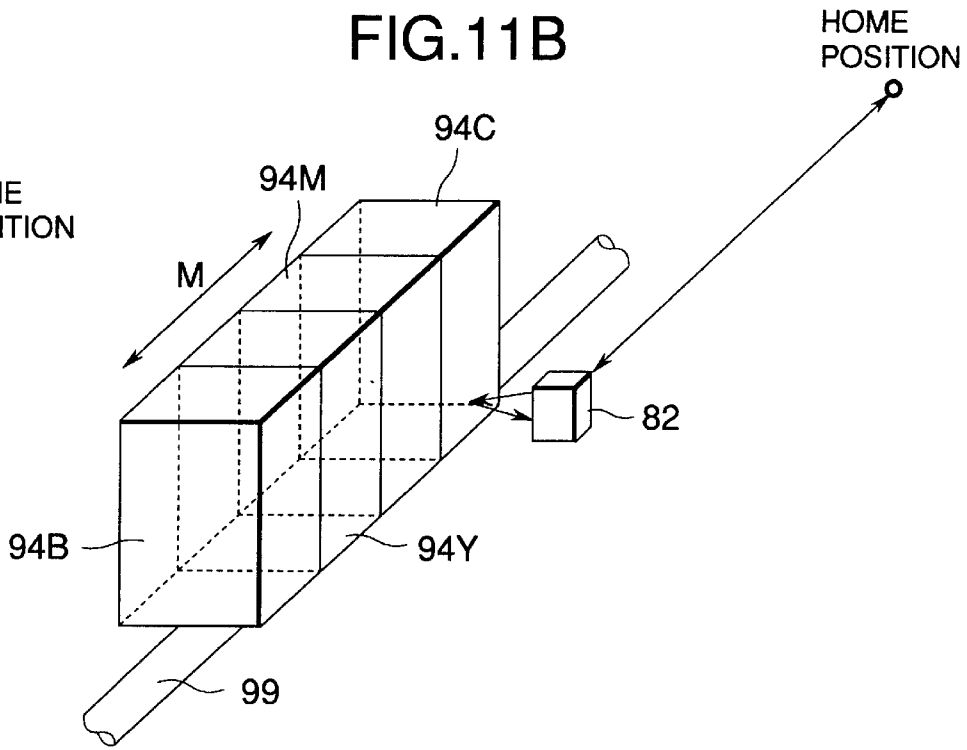
FIGS. 11A and 11B illustrate the ink sensor 82 and the ink tanks 94B, 94Y, 94M, and 94C.
Figure 11A:
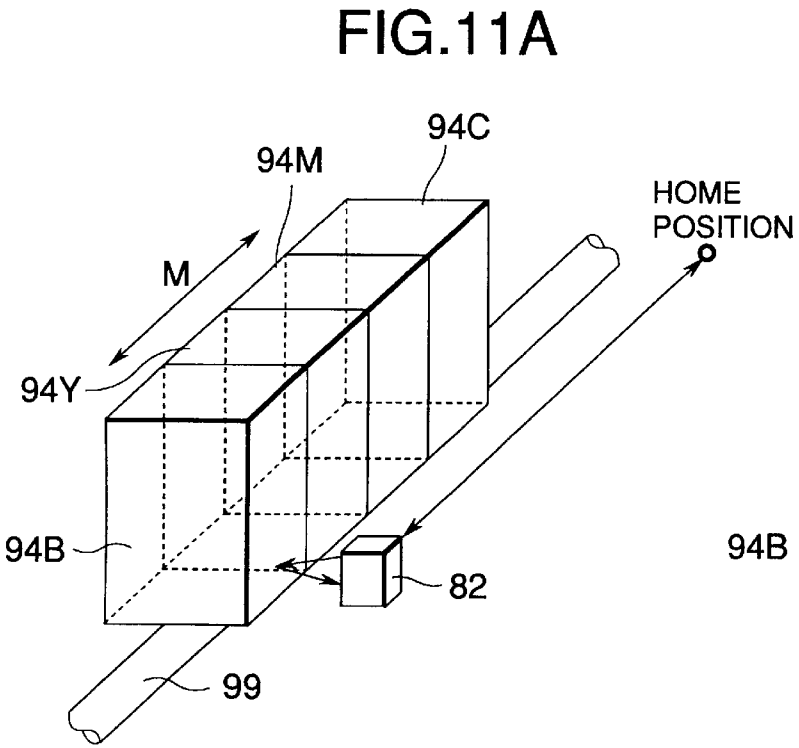

FIGS. 11A and 11B illustrate the ink sensor 82 and the ink tanks 94B, 94Y, 94M, and 94C.

The ink tanks 94B, 94Y, 94M, and 94C are made of a transparent or translucent material and are aligned at predetermined intervals in the carriage 72 along the carriage shaft 99. The ink sensor 82 is of a reflection type. The ink sensor 82 is located at a predetermined distance from a home position of the carriage. The carriage 72 can be positioned at accurate distances with respect to the home position such that each ink tank is right in front of the ink sensor 82 with the ink sensor 82 at laterally centered position of the ink tank. The ink sensor 82 illuminates the wall of the ink tank in front of it. The light emitted from the ink sensor 82 impinges the wall at a predetermined height from the bottom and is then reflected back to the ink sensor 82. The ink sensor 82 receives the reflected light, thereby detecting the remaining ink of the ink tank. The ink sensor 82 outputs a detection signal having a first sensor level corresponding to "ink plus transparent material of the tank" if the ink level is higher than the predetermined height, and a second sensor level corresponding to "transparent material of the tank" if the ink level is lower than the predetermined height.

Referring to FIG. 10, an A/D converter 85 converts the detection signal of the ink sensor 82 into a digital signal. The controller 90 receives the digital signal to determine a low-ink condition of the ink tank. A comparator, not shown, may be used in place of the A/D converter 85 to determine a low-ink condition. The comparator compares the detection signal with a predetermined reference level and outputs a low-ink signal if the ink level is lower than the predetermined height of the tank. The ink sensor may be of a transmission type.

Figure 12:
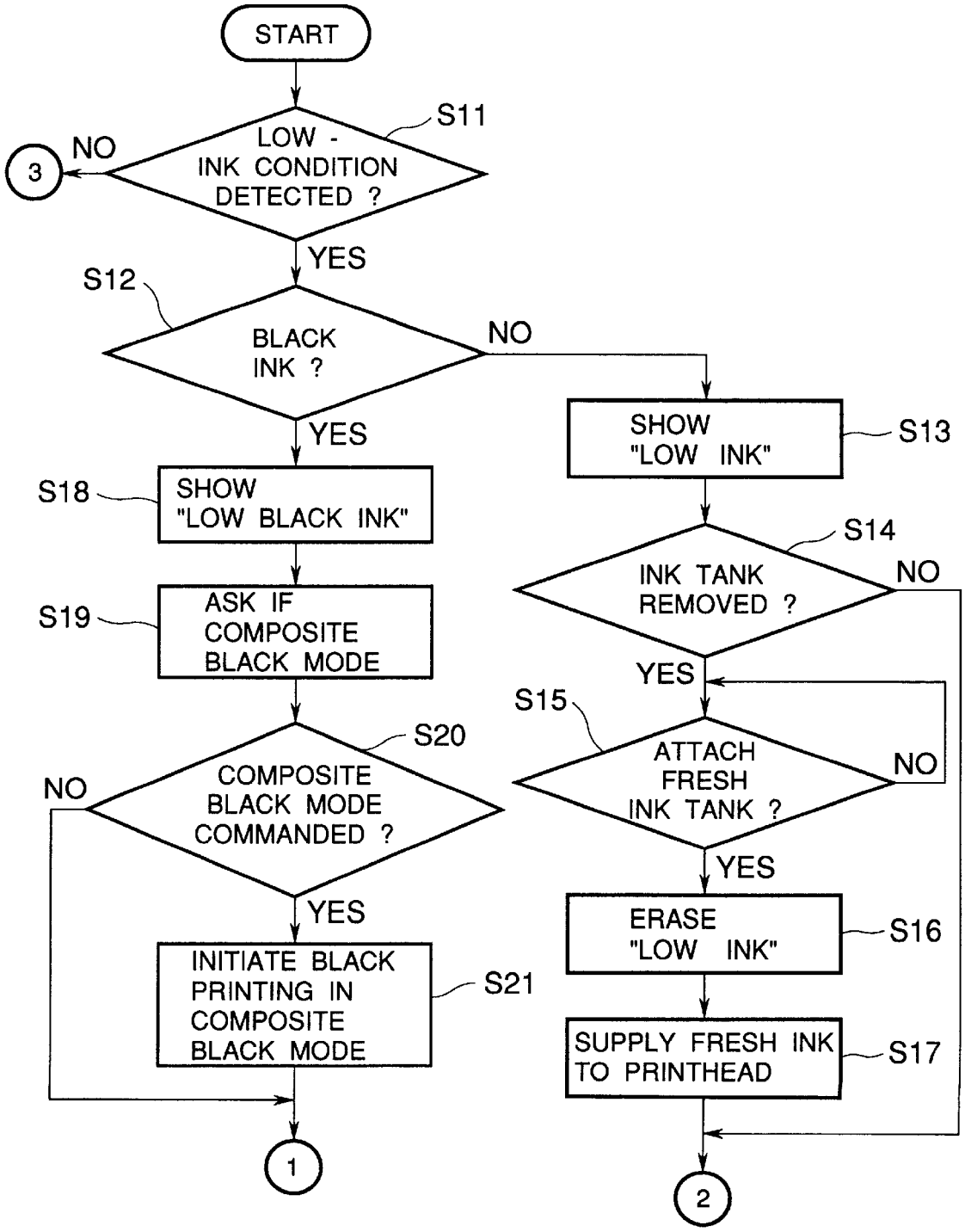
FIGS. 12–13 are flowcharts which illustrates the operation of indicating a low-ink condition in the fourth embodiment.
Figure 13:
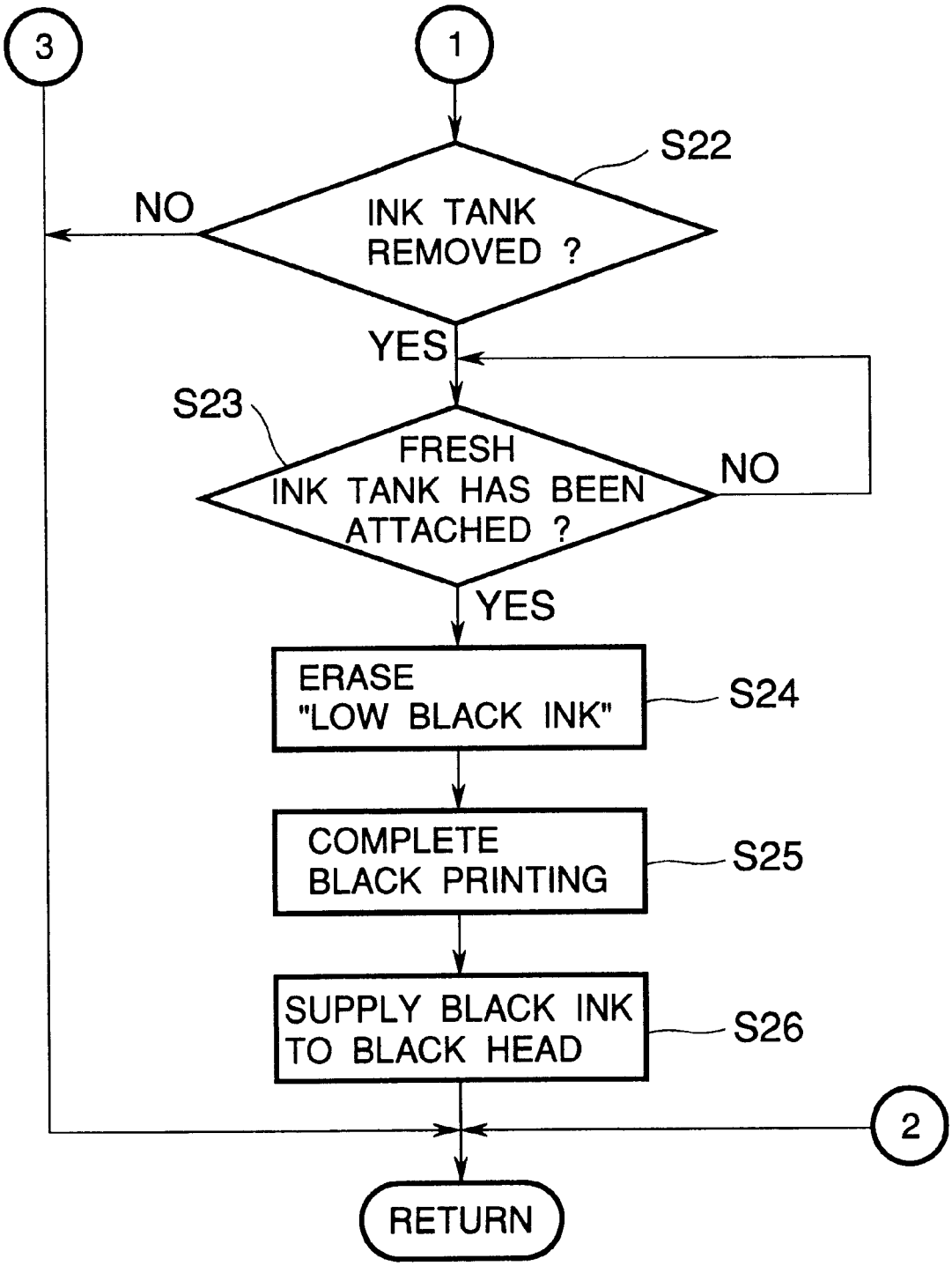

The operation of the ink jet printer of the aforementioned construction will be described with reference to first and second flowcharts shown in FIGS. 12 and 13. FIGS. 12 and 13 illustrate the operation of indicating an low-ink condition.

During a normal printing operation, the ink levels of the ink tanks are detected at ends of each printed line or each printed page. For this purpose, the spacing motor 70 (FIG. 10) is driven in rotation to move the carriage 72 (FIG. 9) so that the ink sensor opposes the ink tanks 96B, 96Y, 96M, and 96C successively, thereby detecting ink levels of the ink tanks 96B, 96Y, 96M, and 96C.

Step 11: A check is made to determine whether the ink sensor 82 has detected a low-ink condition of any one of the ink tanks; if NO, the program returns.

Step 12: If at least one ink tank is found to be at a low-ink condition, then a check is made to determine whether the black ink tank is at a low-ink condition.

Step 13: If an ink tank other than the black ink tank is found to be at a low-ink condition, information on this condition is sent via an interface, not shown, to a host apparatus, not shown, so that "LOW INK" is displayed on a display device of the host apparatus. If the ink Jet recording apparatus has a display device, the indication "LOW INK" may also be displayed on the display device of the ink jet recording apparatus.

Step 14: The controller 90 checks the detection result of the sensor unit 78 to determine whether the user has removed an ink tank of a low-ink condition.

Step 15: The controller waits till a fresh ink tank has been attached.

Step 16: If the ink tank at a low-ink condition has been removed, then the controller 90 erases the message "LOW INK" from the display device shortly after a fresh ink tank has been attached to the carriage 72.

Step 17: Fresh ink is supplied to the corresponding head.

Step 18: If the ink tank 96B of black ink is found to be at a low-ink condition at Step 12, the message "LOW BLACK INK" is displayed on the display device of the host apparatus.

Step 19: Subsequently, under the control of a printer driver software stored in the ROM 92, the controller displays a message such as "Do you perform black printing with color inks?" on the display device, asking the user whether a composite-black mode should be activated. The printer driver software is a program used for generating various items of data in accordance with the design specification of the printer. The composite-black mode is a print mode where the yellow head 94Y, magenta head 94M, cyan head 94C eject ink drops of the corresponding colors to print one over the other for composite-black dots or effective black dots.

Step 20: A check is made to determine whether the composite-black mode has been specified.

Step 21: If the composite-black mode has been commanded by the user, means in the controller 90, not shown, initiates a black printing in the composite-black mode.

Step 22: A check is made to determine whether the ink tank 96B has been removed. If YES, the program proceeds to step 23; if NO, the program returns.

Step 23: The controller 90 waits till a fresh ink tank has been attached.

Step 24: The controller 90 erases the characters "LOW BLACK INK" from the display device.

Step 25: The black printing is completed.

Step 26: The fresh black ink tank supplies black ink to the black head 94B.

Next, the routine of the composite-black mode will be described.

Figure 14:
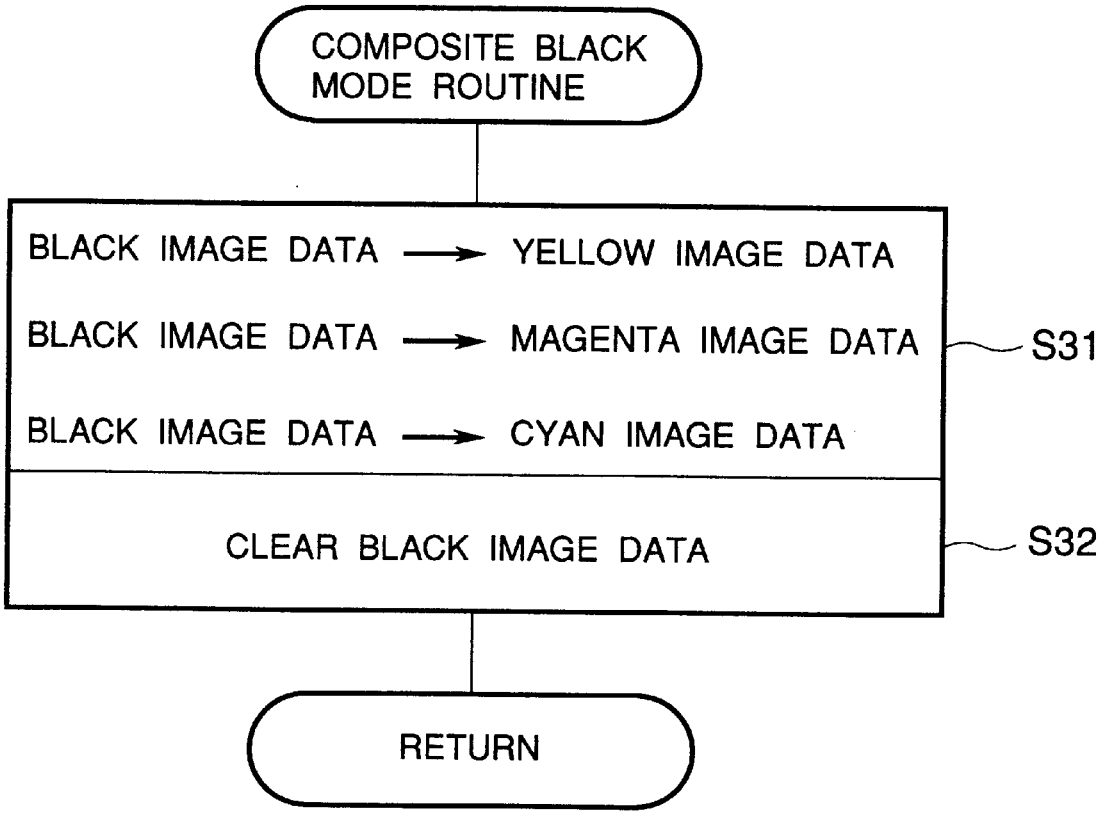
FIG. 14 is a flowchart illustrating the routine of the composite-black mode according to the fourth embodiment.

FIG. 14 is a flowchart illustrating the routine of the composite-black mode according to the fourth embodiment.

When the composite-black mode has not activated yet, the controller 90 (FIG. 10) receives the print data from a host apparatus, not shown, and sends the print data as black image data to the black head 94B for black printing.

Step 31: When the composite-black mode is activated, the controller 90 sends the black image data as yellow image data to the yellow head 94Y, as magenta image data to the magenta head 94M, and as cyan image data to the cyan head 94C, respectively. Thus, the heads 94Y, 94M, and 94C eject corresponding colored ink drops one over the other, thereby printing composite-black dots.

Step 32: The black data is cleared (erased).

As described above, when the black ink tank 96B is found to be at a low-ink condition, if there is no fresh black ink tank 96B available and the remaining ink may not be enough to complete the current black printing, the user may command the composite-black mode where yellow ink, magenta ink, and cyan ink are printed one over the other to perform "black printing". This feature prevents the missing dots from the printer output resulting from the fact that ink runs dry.

This feature may be incorporated in the printer without additional cost to the printer since the construction of the printhead 94 need not be changed. If somewhat unusual appearance of the print is not acceptable to the user, the black ink tank at a low-ink condition may be replaced by a fresh black ink tank rather than activating the composite-black mode. Thus, black printing may be performed in different ways depending on situations.

Although the black printing is performed using three colors, i.e., yellow ink, magenta ink, and cyan ink, the black printing may be performed using two colors, i.e., magenta ink and cyan ink. Using magenta ink and cyan ink in black printing may result in stripes of black and purple. The stripes may be made less noticeable by increasing resolution of the printer output.

Fifth Embodiment

The construction of a fifth embodiment is the same as that of the fourth embodiment.

Figure 15:
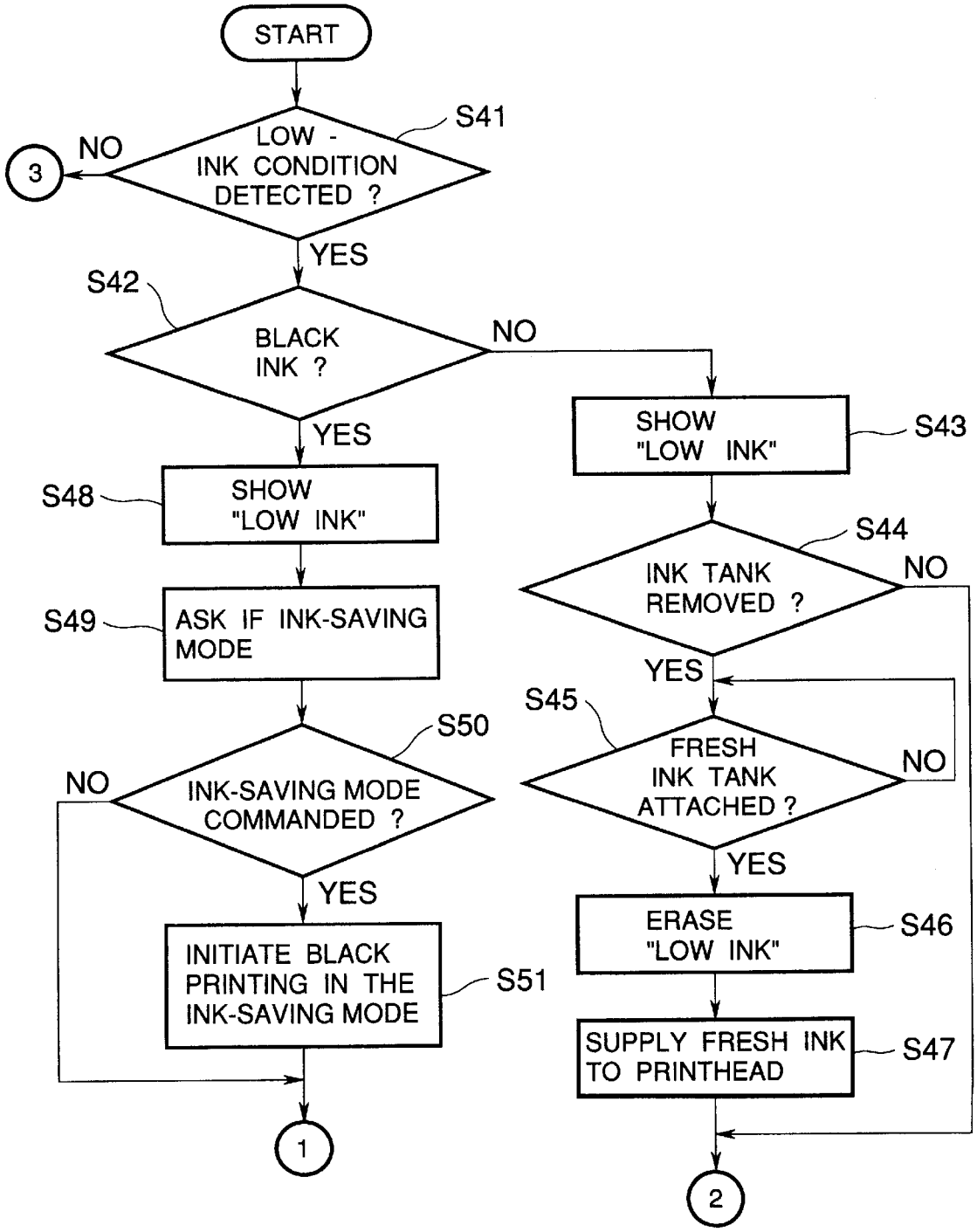
FIGS. 15 and 16 are flowcharts, illustrating the operation for indicating a low-ink condition according to a fifth embodiment.
Figure 16:
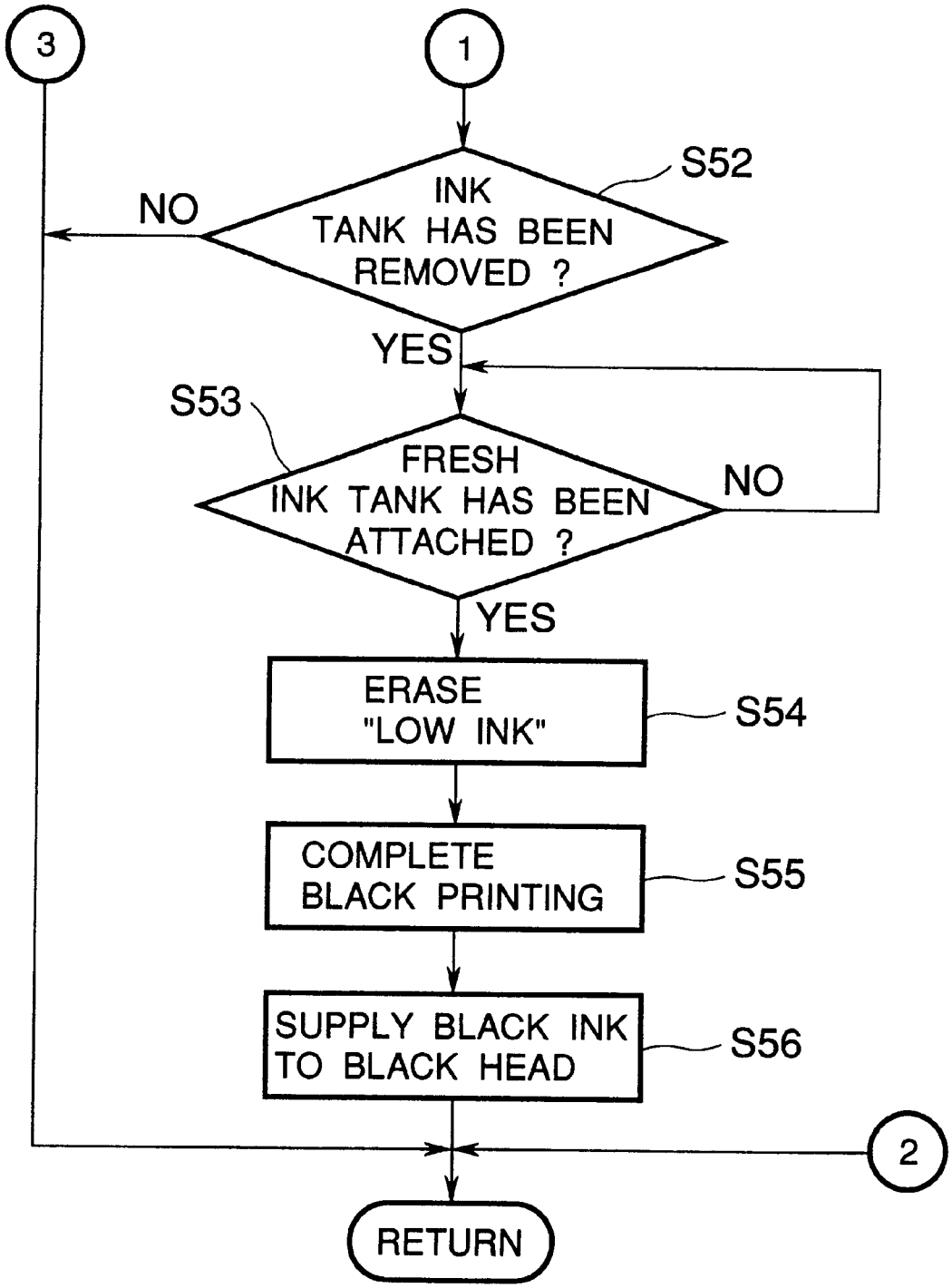

FIGS. 15 and 16 are flowcharts, illustrating the operation of indicating a low-ink condition according to a fifth embodiment. The operation of the fifth embodiment will be described with reference to FIGS. 15 and 16.

Step 41: A check is made to determine whether the ink sensor 82 has detected a low-ink condition of any one of ink tanks 96B, 96Y, 96M, and 96C; If YES, the program proceeds to step 42; if NO, the program returns.

Step 42: A check is made to determine whether the black ink tank is at a low-ink condition. If YES, the program proceeds to step 48; if NO, an ink tank other than the black ink tank is at a low-ink condition and thus the program proceeds to step 43.

Step 43: The controller sends information on the ink low level condition to a host apparatus, not shown, which displays a message such as characters "LOW INK" on a display device of the host apparatus.

Step 44: The controller 90 checks the output of the sensor unit 78 to determine whether the user has taken out the ink tank from the printer. If YES, the program proceeds to step 45; if NO, the program returns.

Step 45: The controller waits till a fresh ink tank has been attached.

Step 46: The controller 90 erases the characters "LOW INK" after a fresh ink tank has been attached.

Step 47: The fresh ink tank supplies fresh ink to the printhead 94 and the program returns.

Step 48: The characters "LOW INK" are displayed on the display device of the host apparatus.

Step 49: Under the control of the printer driver software stored in the ROM 92, the controller 90 displays a question asking the user as to whether the ink-save made should be activated.

Step 50: A check is made to determine whether the ink save made has been commanded. If YES, the program proceeds to step 51; if NO, the program proceeds to step 52.

Step 51: If the user has input a command for the ink-save mode, means, no shown, in the controller 90 resumes the black printing in the ink-save mode. As a result, the black printing is performed such that the yellow ink, magenta, and cyan ink are used less in amount.

Step 52: The controller 90 checks the output of the sensor unit 78 to determine whether the ink tank 96B has been taken out. If YES, the program proceeds to Step 53.

Step 53: The controller 90 checks the output of the sensor unit 78 to determine whether a fresh ink tank has been attached. The controller waits till a fresh ink tank has been attached.

Step 54: The controller 90 erases "LOW INK" on the display device.

Step 55: The controller resumes and completes the black printing.

Step 56: Fresh black ink is supplied to the black head 94B. Then, the black ink is supplied to the black head 94B.

The routine of the ink-save mode will now be described with reference to FIGS. 17–19.

Figure 17:
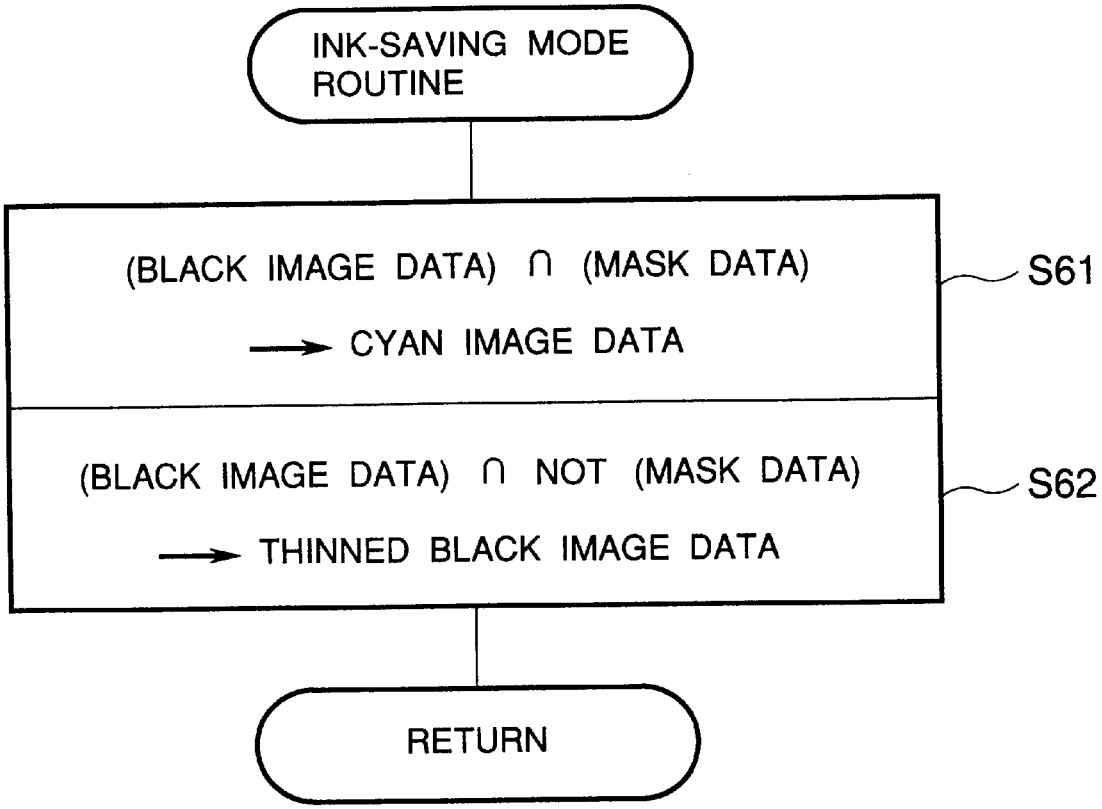
FIG. 17 is flowchart illustrating the routine of the ink save made according to a fifth embodiment.

FIG. 17 is a flowchart illustrating the routine of the ink save made according to a fifth embodiment.

FIG. 18 illustrate a method of generating cyan image data.

FIG. 19 illustrates a method of generating black image data.

Before the ink-save mode is activated, the controller 90 (FIG. 10) receives print data from a host apparatus, not shown, and sends the received data as black image data to the black head 94B for black printing.

Step 61: When the ink-save mode is activated, the logical product of the black image data and predetermined mask data is computed to produce the cyan image data as shown in FIG. 18. The mask data is such that 1's and 0's are arranged in a checker flag pattern.

Step 62: The logical product of the black image data and the inverted mask data is computed, thereby thinning the black image data to form thinned black image data as shown FIG. 19.

Figure 20:
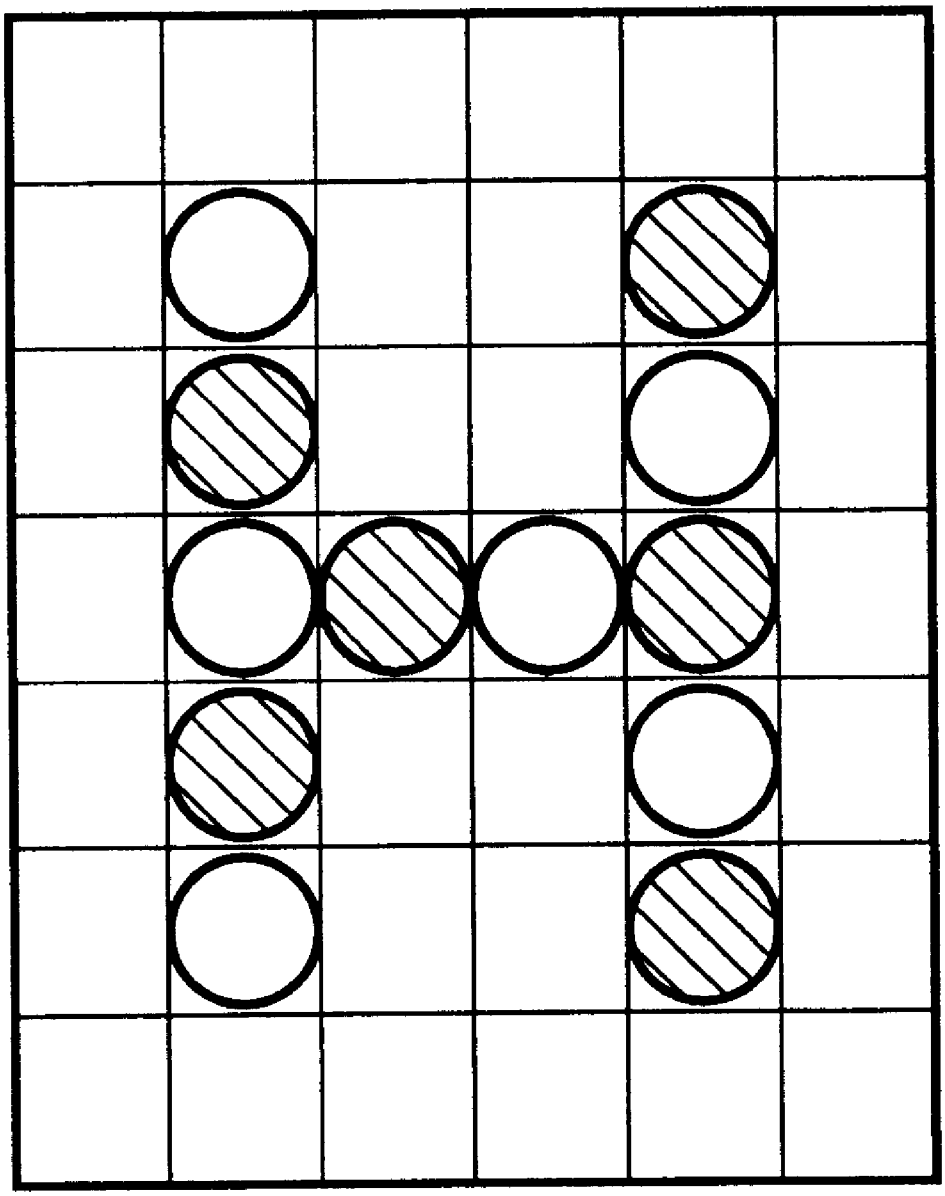
FIG. 20 shows the resulting printer output.

FIG. 20 shows the resulting printer output. In this manner, black printing can be performed using black ink and cyan ink.

In FIGS. 18 and 19, 1's are bit data for forming dots and 0's are bit data not for forming dots.

Referring to FIG. 20, hatched circles are dots formed with thinned black image data, non-hatched circles are dots formed with cyan image data.

In this case, the black-ink dots and cyan-ink dots are both present in the resulting print and the resulting printer output looks generally bluish black. However, the resulting printer output provides a better print density and print quality compared to a simply thinned image data.

As mentioned above, when the black ink tank is found to be at a low-ink condition, if there is no stock of the black ink tank 96B and the remaining ink may not be enough for completing the current black printing, the user may command the ink-save mode where black ink dots and cyan ink dots are both present in the print. This prevents the missing dots from the printer output data resulting from the fact that ink runs dry in the middle of the printing operation.

This advantage is achieved without additional cost to the printer since the construction of the printhead 94 need not be changed. If the somewhat different appearance of the print from usual is not acceptable to the user, the user may attach a fresh black ink tank 96B rather than activating the ink-save mode. This feature provides options depending on the desire of the user and situation. Should either the black ink tank 96B or the cyan ink tank 96C be found to be at a low-ink condition in the middle of a black printing, only an in tank at a low-ink condition needs to be replaced in order to complete the black printing.

Although the black printing is carried out with black ink and cyan ink in the aforementioned fifth embodiment, magenta ink may also be used in place of cyan ink, in which case the resulting printer output looks brownish black.

If the black ink tank is found to be at a low-ink condition, the black printing is performed with the black ink dots and cyan ink dots present in the print. Thereafter, when the cyan ink tank is found to at a low-ink condition, the black printing can be carried on with the black ink dots and the magenta ink dots present in the print.

Furthermore, instead of using cyan ink and black ink, the black printing may be carried out with yellow ink, magenta ink, and cyan ink printed one over the other, or with magenta ink and cyan ink printed one over the other. However, it may be more desirable that black printing is performed using black ink and cyan ink since we are accustomed to writing in black ink or blue ink.

Sixth Embodiment

The construction of a sixth embodiment is the same as that of the fourth embodiment.

Figure 21:
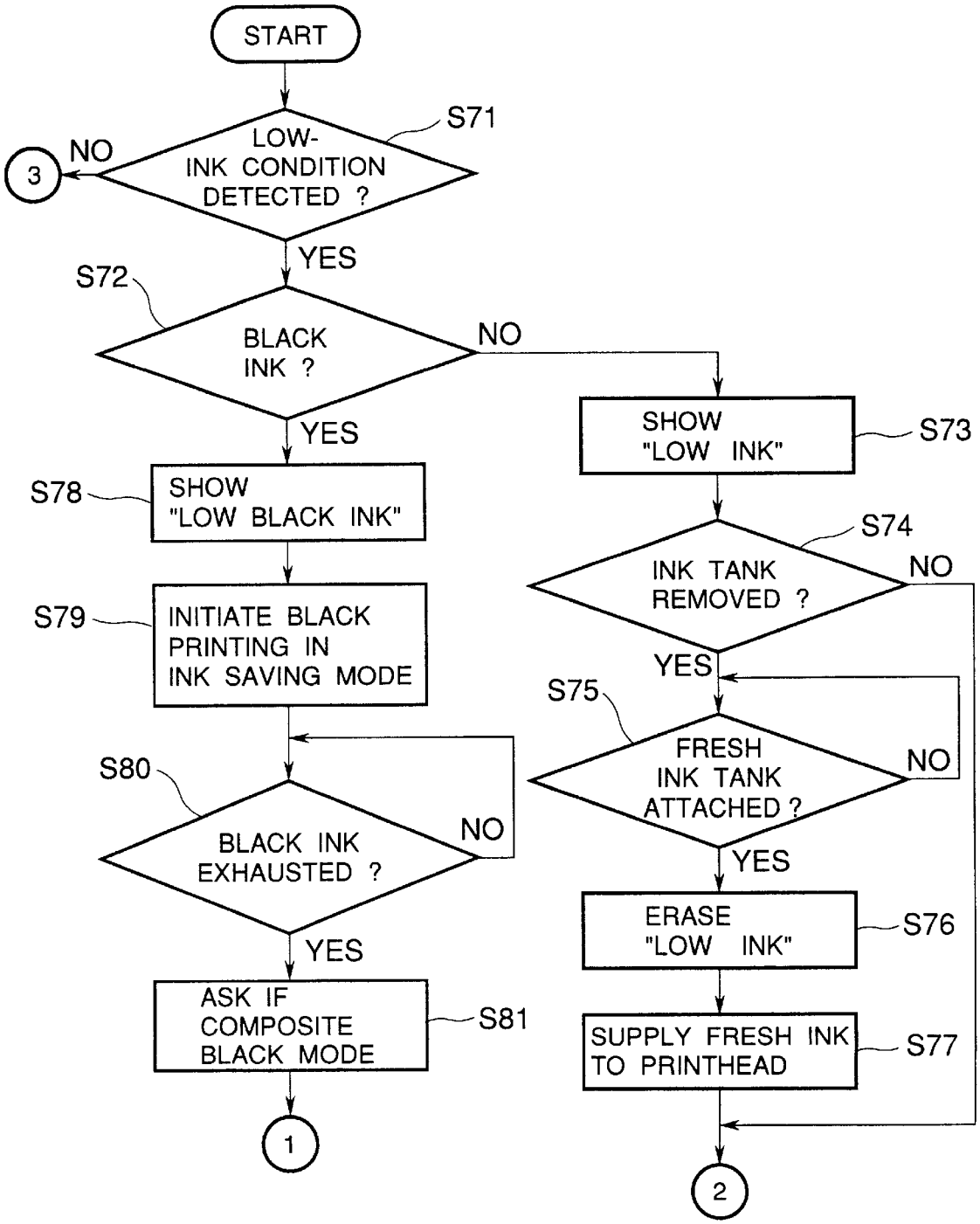
FIGS. 21 and 22 are flowcharts illustrating the operation of indicating a low-ink condition of an ink jet printer according to the sixth embodiment.
Figure 22:
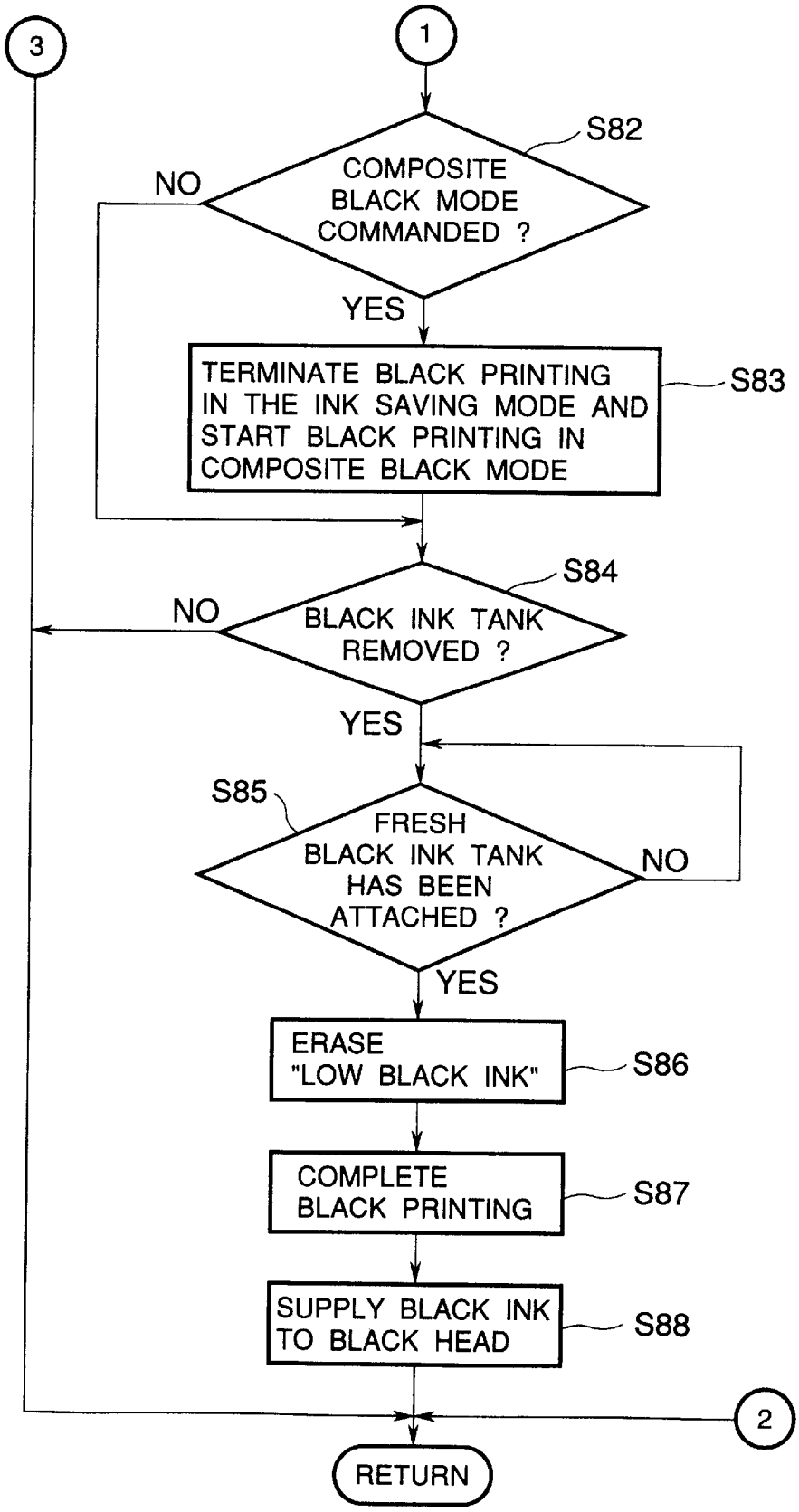

FIGS. 21 and 22 are flowcharts illustrating the operation of indicating a low-ink condition of an ink jet printer according to the sixth embodiment.

The flowcharts will be described with reference to FIGS. 21 and 22.

Step 71: A check is made to determine whether any one of the ink tanks (FIG. 10) 96B, 96Y, 96M, and 96C has been found to be at a low-ink condition; if YES, the program proceeds to Step 72 and if NO, the program returns.

Step 72: A check is made to determine whether the black ink tank 96B is at a low-ink condition. If YES, the program proceeds to Step 78; if NO, the program proceeds to Step 73.

Step 73: The host apparatus displays, for example, characters "LOW INK" on its display device. If the ink jet recording apparatus has a display device, the indication "LOW INK" may also be displayed on the display device of the ink jet recording apparatus.

Step 74: The controller 90 checks the output of the sensor unit 78 to determine whether the user has removed the ink tank at a low-ink condition. If YES, the program proceeds to Step 75; if NO, the program returns.

Step 75: The controller 90 checks the output of the sensor unit 78 to determine whether a fresh ink tank has been attached. If YES, the program proceeds to Step 76; If NO, the controller waits till a fresh ink tank has been attached.

Step 76: The controller 90 erases the indication of a low-ink condition from the display device.

Step 77: The fresh ink tank supplies ink to the printhead 94.

Step 78: When the black ink tank is found to be at a low-ink condition at Step 72, an indication such as a message "LOW BLACK INK" is displayed on the display device of the host apparatus.

Step 79: Subsequently, the controller starts black printing in the ink saving mode under the control of the printer driver software stored in the ROM 92.

Step 80: A check is made to determine whether black ink has been exhausted. If YES, the program proceeds to Step 81; if NO, the program waits till the black ink runs dry.

Step 81: Under the control of the printer driver software stored in the ROM 92, the controller 90 shows a message on the display device, asking the user as to whether the composite-black mode should be activated.

Step 82: A check is made to determine whether the composite-black mode has been commanded. If NO, the program jumps to Step 84; if YES, the program proceeds to Step 83:

Step 83: The black printing in the ink-save mode is terminated and the black printing in the composite-black mode is started.

Step 84: The controller 90 checks the output of the sensor unit 78 to determine whether the user has removed the black ink tank 96B. If YES, the program proceeds to Step 85; if NO, the program returns.

Step 85: A check is made to determine whether a fresh black ink tank 96B has been attached. If YES, the program proceeds to Step 86; if NO, the program waits till a fresh ink tank has been attached.

Step 86: The controller erases the message "LOW BLACK INK" from the display device.

Step 87: The printing is carried out to complete the black printing in the ink-save mode or in the composite-black mode.

Step 88: The fresh black ink tank 96 supplies fresh black ink to the black head 94B.

In the fourth to sixth embodiments, the printhead 94 includes the black head 94B, yellow head 94Y, magenta head 94M, and cyan head 94C. For example, the entirety of printhead 94 may be made in a one piece construction. Alternatively, the printhead 94 may have the yellow head 94Y, magenta head 94M, and cyan head 94C formed in a one piece construction and the the black head 94B formed separately.

Still alternatively, the black head 94B, yellow head 94Y, magenta head 94M, and cyan head 94C may be made separate from each other and assembled together.

Seventh Embodiment

The construction of a seventh embodiment is the same as that of the first embodiment.

Because the composite-black dots 31T1, 31T2, . . . , 31Tn are formed by printing the yellow ink, magenta ink, and cyan ink, one over the other, the optical density (OD values) of the resulting composite-black dots is lower than the single-black dots 31B1, 31B2, . . . , 31Bn formed of black ink only.

FIG. 23 shows a table which lists the tones of printer outputs when a printing were performed using composite black and single black. Printings of images were performed on three kinds of paper i.e., coated paper, ordinary paper A, and ordinary paper B using composite black and single black. The printed results were evaluated in terms of optical density and CIE L*a*b* values. L* values represent lightness, and a* values and b* values represent chromaticness.

The positive values indicate that the formed composite-black dots are more reddish while the negative values indicate that the formed composite-black dots are more greenish. The positive b* values indicate that the formed composite-black dots are more yellowish while negative b* values indicate that the formed composite-black dots are more bluish. The closer to zero the a* values and b* values are, the closer to achromatic color the formed composite-black dots are.

As is clear from the table shown in FIG. 23, the composite-black dots printed in composite black have lower optical densities and are more reddish and more bluish than those printed in single black.

Figure 24:
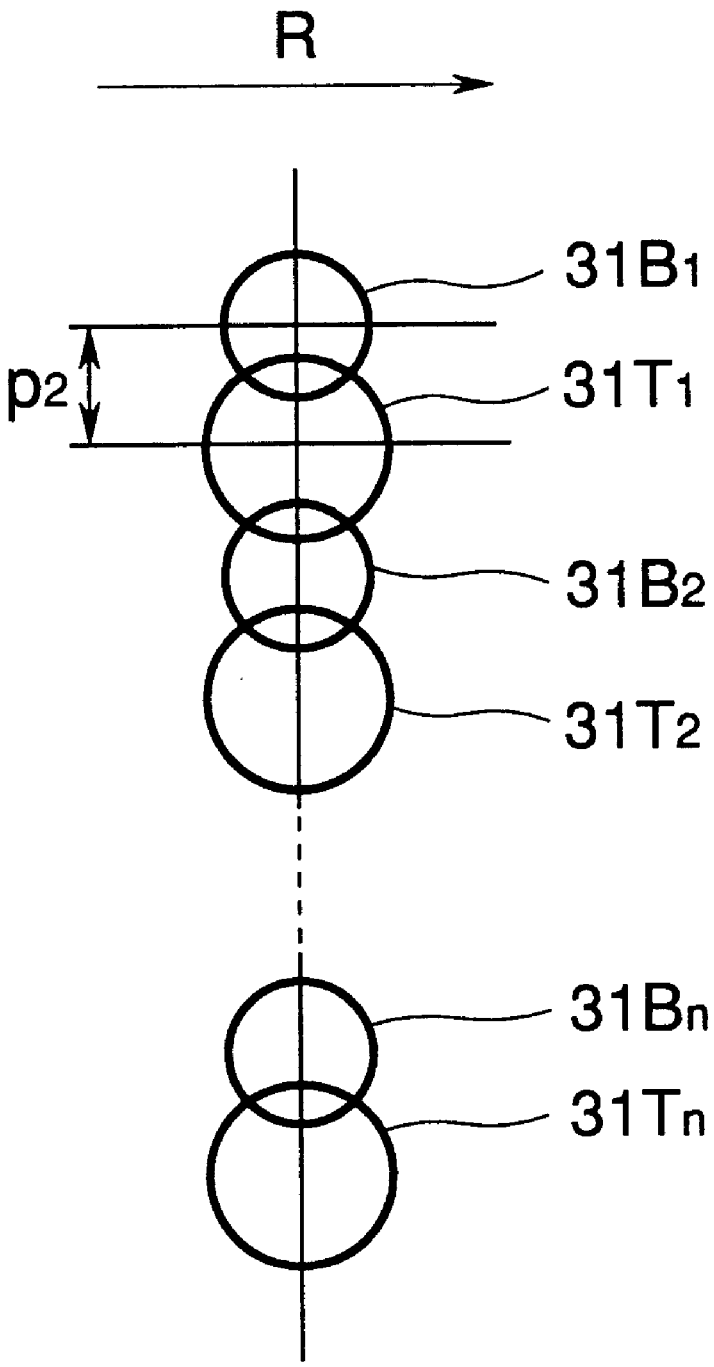
FIG. 24 shows the diameters of the single-black dots and the composite-black dots in the seventh embodiment.

Therefore, in the seventh embodiment, as shown in FIG. 24, the diameter of the single-black dots 31B1, 31B2, . . . , 31Bn is made smaller than that of the composite-black dots 31T1, 31T2, . . . 31Tn.

For this purpose, when the black printing is performed, a controller causes the head-driving circuit as shown in FIG. 6 to drive the orifices 22B1, 22B2, . . . , 22Bn (FIG. 2), thereby ejecting single black ink drops smaller than composite black ink drops of a normal size. In other words, the electrodes 43*a* and 43*b* (FIG. 1) receive the electrical signal having a lower voltage or a shorter duration than when printing using composite black.

The smaller size of the single black ink drops improves the quality of the printer output. Thus, if the quality of the print is of prime importance, then the black ink drops should be made smaller than those of the colored inks. However, if a uniform dot diameter is of prime importance, then the ink drops of each colored ink should be made smaller than those of the black ink so that the single-black dots and composite-black dots are of the same size.

Alternatively, the ink drops 31T1, 31T2, . . . , 31Tn of composite black may be made larger than the normal-sized ink drops 31B1, 31B2, . . . , 31Bn of single black in order to achieve the same effect.

Although composite black is produced by using yellow ink, magenta ink, and cyan ink, the composite black may also be produced using colored inks other than yellow ink, magenta ink, and cyan ink.

The head-driving circuit of the seventh embodiment is the same as that of the second embodiment shown in FIG. 6 and therefore only the operation different from the second embodiment is described.

The ratio of the gradation data dB1, dB2, . . . , dBn to the gradation data dT1, dT2, . . . , dTn is 0.7/1. Thus, the black head 94B operates to form the single-black dots 31B, 31B2, . . . , 31Bn using single black, the single-black dots 31B1, 31B2, . . . , 31Bn being smaller than the composite-black dots 31T1, 31T2, . . . 31Tn formed by the yellow, magenta, and cyan heads which operate to print the yellow ink, magenta ink, and cyan ink, one over the other. The gradation can be selected by the user by inputting a command for a specific gradation level from outside. In this manner, the quality of printer output is improved.

Eighth Embodiment

For example, the printhead 21 of the second embodiment can be used to control the size of the ink drop 47 (FIG. 1) in order to perform color printing with gradation. However, if the size of the ink drop 47 is controlled only in a narrow range, the print quality is impaired. In other words, if a printing is performed using a printhead which is designed to eject ink drops to form low density dots ranging from 40 to 70 $\mu$m in diameter, dots ranging from 100 to 120 $\mu$m for low resolution (e.g., 300 dpi) cannot be achieved.

As a result, if such a printhead is used, the print density is low and white areas between dots are noticeable. An eighth embodiment is directed to an apparatus which can print larger dots without decreasing printing speed.

Figure 26:
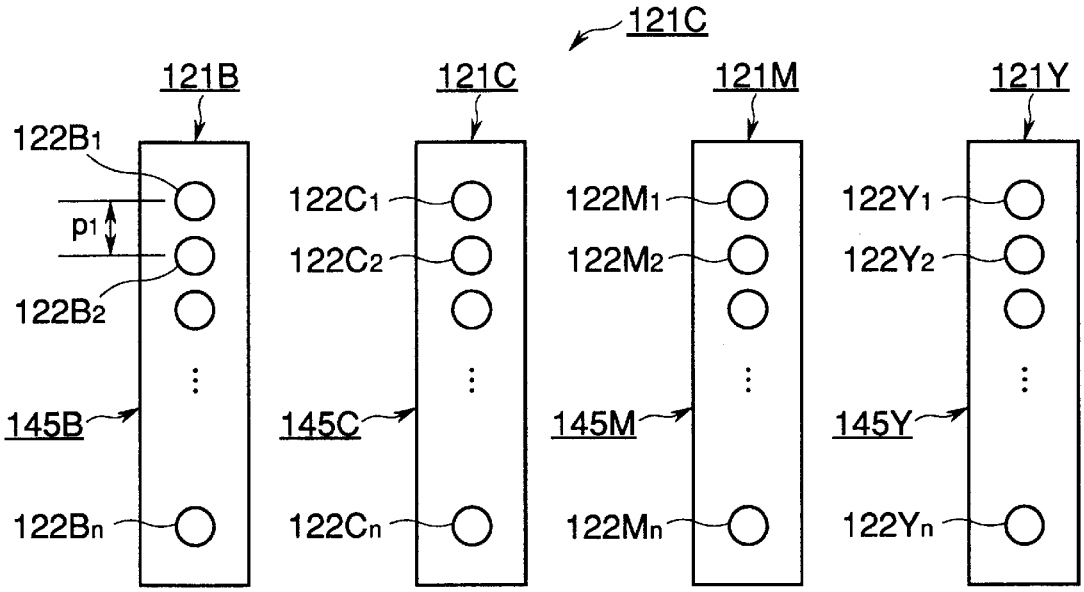
FIG. 26 illustrates the arrangement of orifices of an ink jet recording apparatus according to the eighth embodiment.

FIG. 26 illustrates the arrangement of orifices of an ink jet recording apparatus according to the eighth embodiment.

Figure 27:
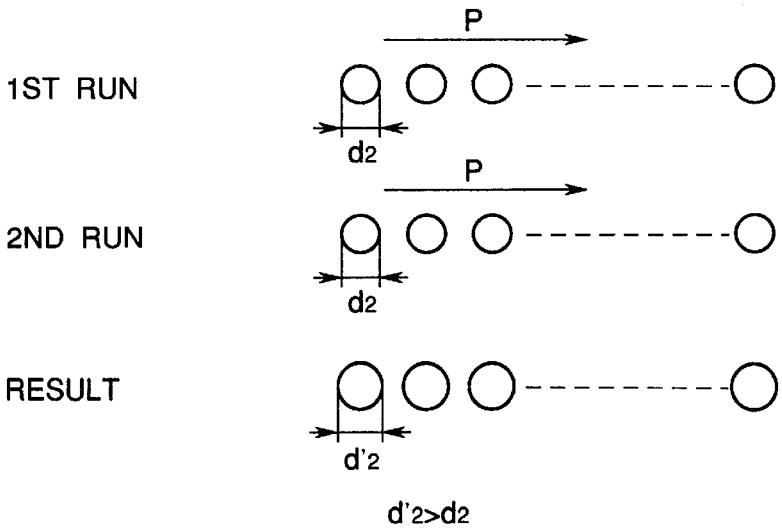
FIGS. 27 and 28 illustrate the dot sizes in first and second kinds of black printing of the eighth embodiment.

FIG. 27 illustrates the dot sizes in a first kind of black printing.

Figure 28:
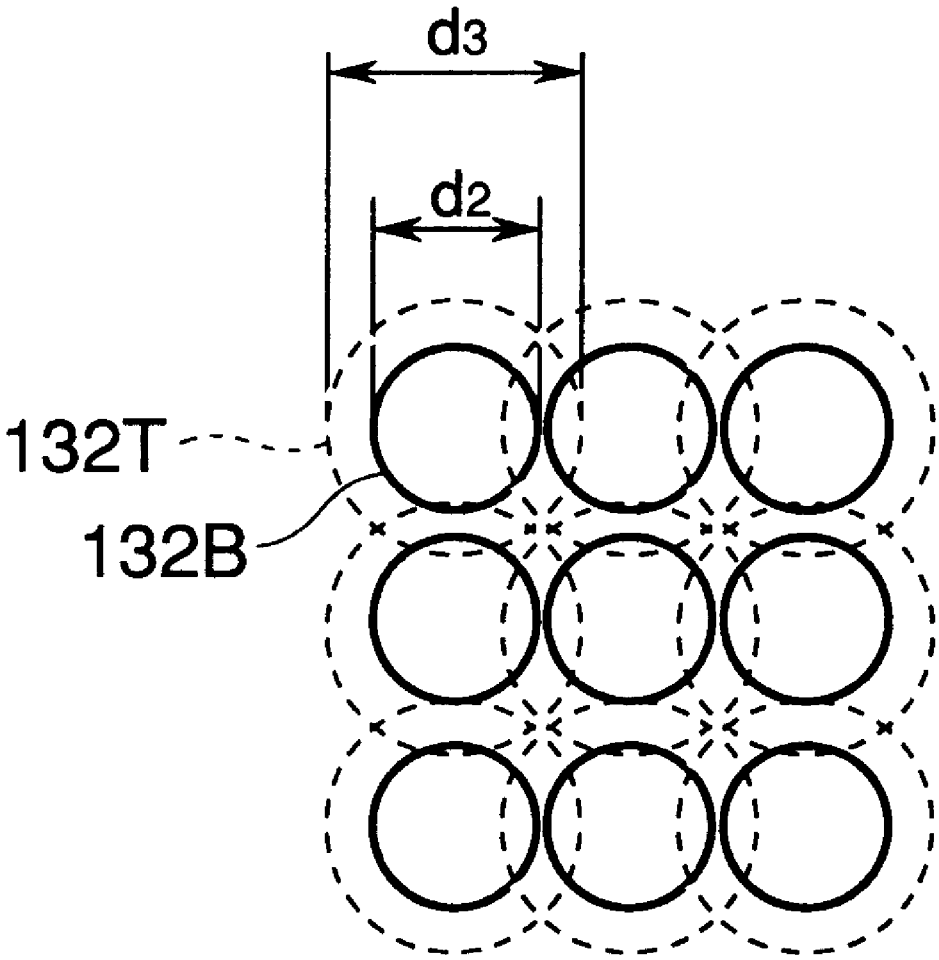

FIG. 28 illustrates the dot size in a second kind of black printing.

Referring to FIG. 26, a printhead 121 includes a black head 121B, yellow head 121Y, magenta head 121M, and cyan head 121C. The black head 121B, yellow head 121Y, magenta head 121M, and cyan head 121C have orifice plates 145B, 145Y, 145M, and 145C, respectively.

The orifice plates 145B, 145Y, 145M, and 145C are formed with orifices 122B1, 122B2, . . . , 122Bn, 122Y1, 122Y2, . . . , 122Yn, 122M1, 122M2, . . . , 122Mn, and 122C1, 122C2, . . . , 122Cn. All the orifices are arranged at intervals of p1=0.085 mm, so that the printhead 121 has a resolution of 300 dpi.

The orifices are arranged so that orifices are at intersections of a matrix having columns extending in the main scanning direction and rows extending in the sub-scanning direction.

The printhead 121 is designed to print a low density image and the diameter of orifices 122B1–122Bn, 122Y1–122Yn, 122M1–122Mn, and 122C1–122Cn lie in the range of minimum d1 to maximum d2. In the eighth embodiment, the dot size ranges from about 40 to 70 microns.

The eighth embodiment provides two kinds of black printing.

A first kind of black printing will be described with reference to FIG. 27.

The printhead is driven to run in the main scanning direction as shown by arrow P to print black dots 132B having a diameter of d2. Then, the printhead is driven to run one more time in the main scanning direction as shown by arrow P to print black dots on the same black dots printed in the preceding scanning, thereby obtaining resultant dots having a larger diameter d2'. The resultant large dots d2' is advantageous in that they increase print density and makes white areas between dots unnoticeable.

A second kind of black printing will be described with reference to FIG. 28.

The printhead 121 runs in the main scanning direction while ejecting ink drops to form dots 132B having a diameter of d2. Also, yellow, magenta, and cyan ink drops are ejected to print a composite black dot 132T on each black dot 132B, one over the other in register.

In this case, the diameter d3 of the dot 132T is larger than the diameter d2 of the dots 132B, increasing the print density as well as making white areas among the dots unnoticeable. The amount of dye solved in the ink also increases, contributing to high print density. When performing black printing, the printhead 121 need not run twice in the main scanning direction, preventing print speed from decreasing.

The diameter of a dot printed by yellow, magenta, and cyan inks in the composite black mode is d3, larger than d2.

Figures 29, 30:
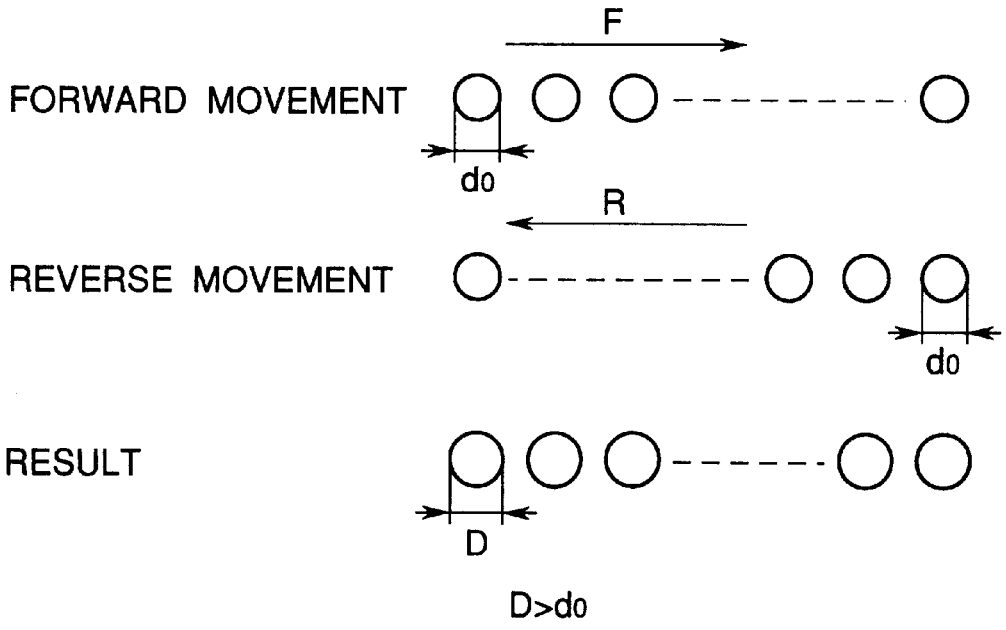
FIG. 29 illustrates experimental print density and diameter of dots of the eighth embodiment.
FIG. 30 shows dotsizes in the ninth embodiment.

FIG. 29 illustrates experimental print density and diameter of dots when black printing is performed using only the black head 121B and when black printing is performed using black head 121B, yellow head 121Y, magenta head 121M, and cyan head 121C.

The order in which yellow, magenta, and cyan are printed one over the other may be selected at will by selecting an order in which the respective heads 121Y, 121M, and 121C are aligned, and a direction in which the printhead 121 is moved relative to the print paper while ejecting ink drops. In this embodiment, color printing is performed at 600 dpi using the dot diameter of d2.

Ninth Embodiment

The eighth embodiment is capable of black printing at low resolution and high speed. A ninth embodiment provides resolutions that the user can select.

FIG. 30 illustrates the dot sizes in a "round-trip printing."

Figure 31:
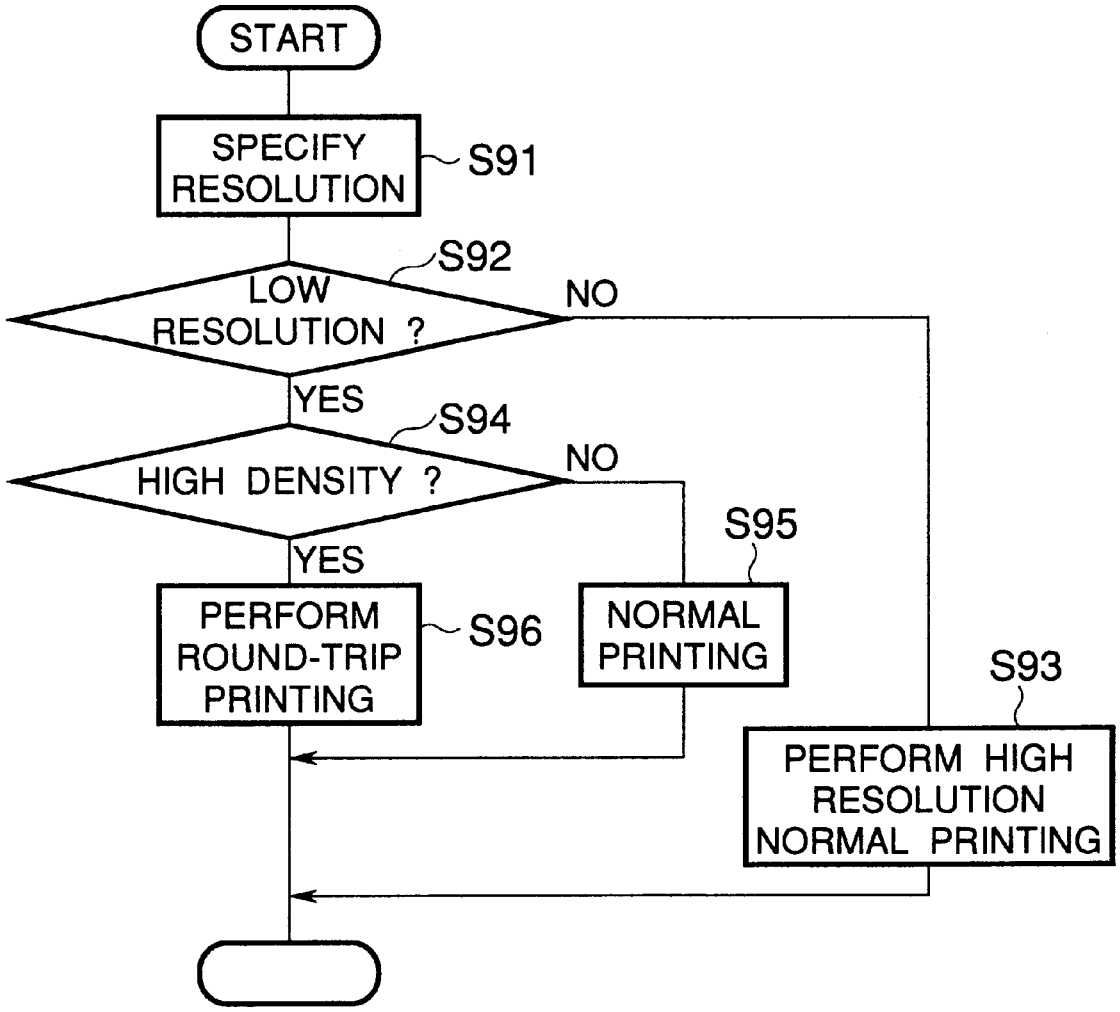
FIG. 31 is a flowchart illustrating the operation of an ink jet recording apparatus according to the ninth embodiment.

FIG. 31 is a flowchart illustrating the operation of an ink jet recording apparatus according to the ninth embodiment.

The ninth embodiment is also capable of color printing at low resolution and high speed.

In other words, the low resolution mode and high resolution mode can be selected according to the user's desire. In the low resolution mode, a high density print operation and a low density print operation can be selectively performed. The selection of desired density can be made by operating an operation panel, not shown.

In the low resolution mode with the high density print operation, printing is not carried out in the normal manner in which the printhead ejects ink drops during its forward movement in the main scanning direction. In other words, the printing is carried out in the "round-trip printing" in which the printhead ejects ink drops during both its forward and reverse movements in the main scanning direction.

Referring to FIG. 30, the printhead ejects ink drops to print dots having a size of d0 during its forward movement shown by arrow F relative to the print paper. Then, the printhead ejects ink drops to print dots having a size of d0 during its reverse movement shown by arrow R, the ink drops forming dots in register with those printed during the forward movement. Alternatively, the printhead may eject ink drops to print dots first in the direction shown by arrow R, then in the direction shown by arrow F.

In the low resolution mode with the low density print operation, the printing is carried out in the normal manner.

In the high resolution mode, printing is carried out in the normal manner with the high resolution operation.

For example, when the color printing is to be performed in the low resolution mode (e.g., 300 dpi), the printing is carried out in the normal manner with a dot size of d2 if the high speed color printing is desired with some sacrifice of print density.

When color printing is to be performed in the low resolution mode with the high density operation, the printhead 121 (FIG. 26) is driven to move relative to the print medium back and forth to carry out the round-trip printing, thereby printing color dots on the black dots one over the other in register. This way of printing decreases the printing speed to nearly half that in the normal printing manner but is twice as fast as the color printing in the high resolution mode with 600 dpi.

Next, the flowchart of FIG. 31 will now be described.

Step S91: a resolution of color printing is specified.

Step S92: a check is made to determine whether the low resolution mode has been selected. If the low resolution mode has been selected, then the program proceeds to step S94, and if not selected, then the program proceeds to step S93.

Step S93: a high resolution normal printing is performed.

Step S94: a check is made to determine whether the high density print operation has been selected. If the high density print operation has been selected, the program proceeds to step S96, and if not, the program proceeds to step S95.

Step S95: the printing is carried out in the normal manner.

Step S96: a round-trip printing is performed.

Tenth Embodiment

In the second embodiment, dots of the respective colors are made smaller when the respective color dots 32Y, 32M, and 32C (FIG. 5) are printed one over the other in register. Composite black dots printed with the respective colored inks of an equal amount have not as good quality as black dots printed with black ink only.

Composite black dots printed with the respective colored inks of an equal amount has a print density 20% lower than black dots printed with only black ink.

A tenth embodiment is directed to an apparatus where composite black dots printed with yellow, magenta, and cyan inks provide as good print quality as black dots printed only with black ink, while still maintaining the same print density.

Figure 32:
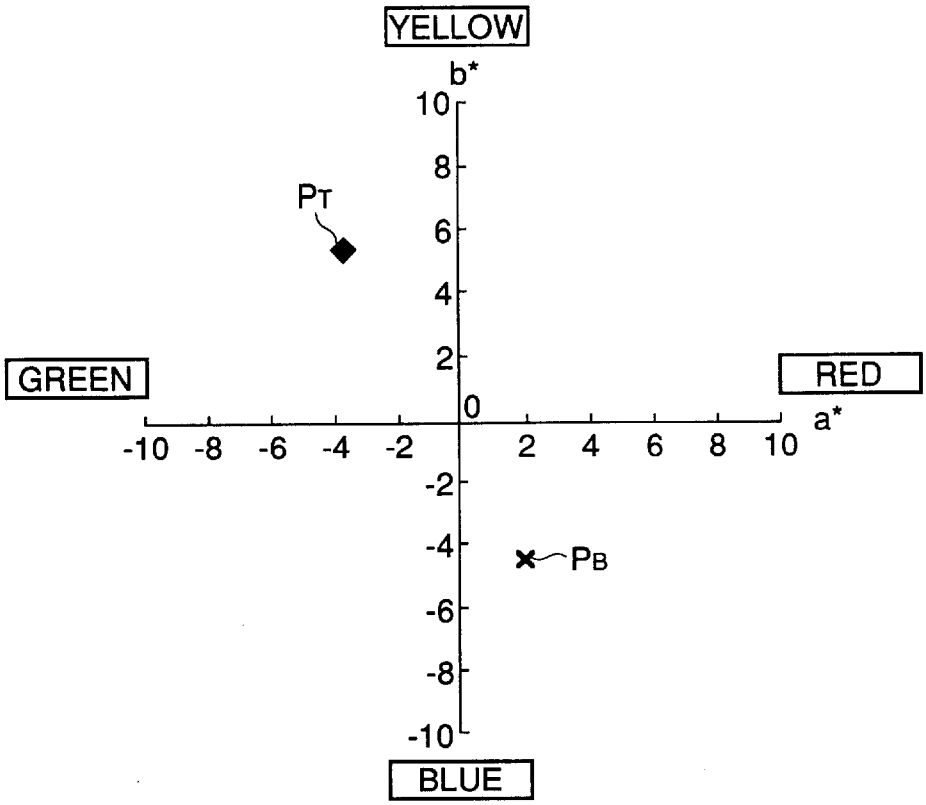
FIG. 32 is a diagram illustrating chromaticness in a tenth embodiment.
Figure 33:
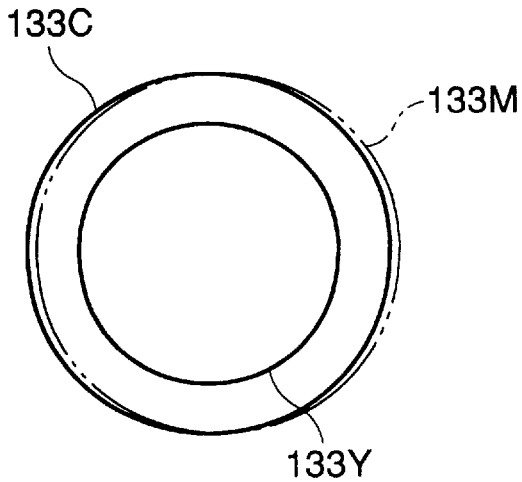
FIG. 33 shows a dot in the tenth embodiment.

FIG. 32 is a diagram illustrating chromaticness in the ninth embodiment and FIG. 33 shows a dot in the ninth embodiment.

According to CIE L*a*b* color system, a* value and b* value represent chromaticness. For positive a* values, the color is more saturated red with increasing value. For negative a* values, the color is more saturated green with increasing value. For positive b* values, the color is more saturated yellow with increasing value. For negative b* values, the color is more saturated blue with increasing value. As the a* value and b* value approach zero, the colors become more achromatic colors.

The chromaticity of a composite black dot printed by mixing yellow, magenta, and cyan is high in the yellow direction and in the green direction as depicted by $P_T$ in FIG. 31 while the chromaticity of a single black dot produced only with black ink is high in the red direction and in the blue direction as depicted by $P_B$. This shows that composite black dots and single black dots are of different shades of color. Therefore, composite black dots will not provide the same image quality as single black dots.

Thus, in the tenth embodiment, an amount of each of yellow, magenta, and cyan ink drops is controlled so as to bring the chromaticity $P_T$ of resultant composite black dots closer to $P_B$ of single black dots.

For example, as shown in FIG. 32, dots of the respective colors are made with an amount of yellow ink smaller than those of magenta and cyan inks. In order to decrease an amount of yellow ink, electrical signals applied to the electrodes 43*a* and 43*b* (FIG. 1) may be decreased in voltage or in drive time.

Instead of increasing the proportion of yellow ink to magenta and cyan inks, the proportion of magenta ink to yellow and cyan inks may be increased. Still alternatively, yellow ink may be decreased and magenta ink may be increased.

As described above, the shade of color of the composite black dots may be brought closer to that of the single black dots, providing print quality similar to that of single black dots.

What is claimed is:

1. An ink jet recording apparatus selectively operable in one of a high definition mode where black printing is performed with high definition and a high speed mode where black printing is performed at high speed, comprising:

a black print head having a number of first orifices aligned in a first direction and spaced apart at a center-to-center distance;

a plurality of color print heads that eject respective different colored ink drops, wherein said color print heads are aligned with said black print head in a second direction that is perpendicular to the first direction, wherein each of said plurality of color print heads has the number of second orifices aligned in a direction that is parallel to the first direction, wherein said color print heads are offset in the first direction with respect to said black print head such that each of said number of second orifices of said plurality of color print heads is disposed substantially at a midway point of the center-to-center distance in the first direction of adjacent first orifices, and wherein corresponding second orifices of the respective color print heads are aligned in a direction that is parallel to the second direction; and means for moving said black print head across a print medium to perform the black printing operation in one of the high definition mode and the high-speed mode, the black printing being performed at a same resolution in the high definition mode and the high-speed mode;

wherein when said means performs the black printing operation in the high definition mode, said means moves said black print head in the second direction while said black print head ejects single black ink drops onto the print medium in accordance with print data, subsequently moves the print medium a distance that is half of the center-to-center distance, in a direction that is parallel to the first direction, and finally moves said black print head across the print medium in a direction that is opposite to the second direction while said black print head ejects single black ink drops onto the print medium in accordance with the print data; and wherein when said means performs the black printing operation in the high-speed mode, said means moves said black print head and said color print heads in the second direction while said black print head and said color print heads eject ink drops onto the print medium in accordance with print data, wherein said black print head ejects single black ink drops to print single black dots, wherein said color print heads each eject an ink drop of a corresponding color on a same area of the print medium to print composite black dots, the ink drop having a volume controlled such that the composite black dots have a shade of color close to that of the single black dots, and wherein the single black dots and the composite black dots are printed such that the single black dots are positioned alternately with the composite black dots in the first direction.

2. The ink jet recording apparatus according to claim 1, further including means for controlling a size of the single-black dots and a size of the composite black dots, according to a command provided by a user.

3. The ink jet recording apparatus according to claim 2, further including means for driving said color print heads to eject ink drops of corresponding colors and said black print head to eject black ink drops, said color print heads being driven for a shorter duration than said black print head.

4. The ink jet recording apparatus according to claim 2, further including means for driving said color print heads to eject ink drops of corresponding colors and said black print head to eject black ink drops, said color print heads being driven by a voltage that is lower than a voltage driving than said black print head.

5. The ink jet recording apparatus according to claim 2, further including means for driving said black print head to eject black ink drops and said color print heads to eject ink drops of corresponding colors, said black print head being driven for a shorter duration than said color print heads.

6. The ink jet recording apparatus according to claim 2, further including means for driving said black print head to eject black ink drops and said color print heads to eject ink drops of corresponding colors, said black print head being driven by a voltage that is lower than a voltage driving said color print heads.

7. An ink jet recording apparatus, comprising:

a black print head having a number of first orifices aligned in a first direction and spaced apart at a center-to-center distance;

a plurality of color print heads that eject respective different colored ink drops, wherein said color print heads are aligned with said black print head in a second direction that is perpendicular to the first direction, wherein each of said plurality of color print heads has the number of second orifices aligned in a direction that is parallel to the first direction, and wherein corresponding second orifices of the respective color print heads are aligned in a direction that is parallel to the second direction;

mode selecting means for selecting a low resolution mode for printing to be performed at a low resolution, and a high resolution mode for printing to be performed at high resolution; and operation selecting means for selecting a low density operation for printing to be performed with low density, and a high density operation for printing to be performed with high density, such that printed dots are larger in the high density operation than in the low density operation, printing speed is greater in the low density operation than in the high density operation, and print quality is better in the high density operation than in the low density operation, and wherein one of the high density operation and the low density operation is selected when the low resolution mode is selected, wherein either said black print head or said color print heads eject ink drops to form dots in the low density operation and both said black print head and said color print heads eject ink drops in the high density operation such that ink ejected by said black print head and ink ejected by said color print heads are printed one over the other to form a black dot.

8. The ink jet recording apparatus according to claim 7, wherein each of the first orifices is aligned in the second direction with a corresponding one of the second orifices, and wherein, when a black printing operation is performed in the high density operation, said black print head ejects a single black ink drop to print a single black dot and said color print heads eject colored ink drops of corresponding colors to print a composite black dot, such that the single black dot and the composite black dot are printed at a same dot position on a print medium.

9. The ink jet recording apparatus according to claim 8, wherein when said high density operation is performed:

said black print head and said color print heads move in a forward direction and a reverse direction of a main scanning path to perform a color printing operation;

said black print head and said color print heads move in the forward direction to print a line while ejecting ink drops to corresponding dot positions in accordance with print data; and said black print head and said color print heads move in the reverse direction to print the same line as in the forward direction, said black print head and said color print heads ejecting ink drops to the same corresponding dot positions as in the forward direction, in accordance with the same print data as in the forward direction.

10. The ink jet recording apparatus according to claim 7, wherein during said low density operation, the black print head and the color print heads move in one of a forward direction and a reverse direction of a main scanning path to eject ink drops to print dots, and during said high density operation, the black print head and the color print heads move in one of the forward direction and the reverse direction of the main scanning path to eject ink drops to print first dots, and move in the other of the forward direction and the reverse direction of the main scanning path to eject ink drops to print second dots at a same dot position as the first dots.

* * * * *